US005741008A

United States Patent [19]

Kiyohara

[11] Patent Number: 5,741,008

[45] Date of Patent: Apr. 21, 1998

[54] AUTOMATIC PAPER FEED APPARATUS

[75] Inventor: Takehiko Kiyohara, Zama, Japan

[73] Assignee: Canon Kabushiki Kaisha, Tokyo, Japan

[21] Appl. No.: 479,187

[22] Filed: Jun. 7, 1995

Related U.S. Application Data

[62] Division of Ser. No. 200,359, Feb. 23, 1994, abandoned, which is a division of Ser. No. 29,958, Mar. 9, 1993, abandoned, which is a continuation of Ser. No. 666,922, Mar. 11, 1991, abandoned.

[30] Foreign Application Priority Data

| | | | |
|---|---|---|---|
| Mar. 12, 1990 | [JP] | Japan | 2-60309 |
| Mar. 12, 1990 | [JP] | Japan | 2-60310 |
| Mar. 30, 1990 | [JP] | Japan | 2-84422 |
| Mar. 30, 1990 | [JP] | Japan | 2-84423 |

[51] Int. Cl.[6] ..... B65H 1/08

[52] U.S. Cl. ..... 271/127

[58] Field of Search ..... 271/109, 119, 271/121, 162, 167, 126, 127, 171

[56] References Cited

U.S. PATENT DOCUMENTS

| | | | |
|---|---|---|---|
| 3,866,903 | 2/1975 | Eppe et al. | 271/119 |
| 4,030,413 | 6/1977 | Young | 271/119 X |
| 4,061,328 | 12/1977 | Fujimoto et al. | 271/121 X |
| 4,212,456 | 7/1980 | Ruenzi | 271/121 X |
| 4,319,740 | 3/1982 | Olseth | 271/119 X |
| 4,437,656 | 3/1984 | Onoda et al. | 271/119 X |
| 4,529,188 | 7/1985 | Sturnick | 271/119 X |
| 4,565,360 | 1/1986 | Runzi | 271/162 X |
| 4,723,129 | 2/1988 | Endo et al. | 346/1.1 |
| 4,729,557 | 3/1988 | Kiyohara | 271/272 |
| 4,740,796 | 4/1988 | Endo et al. | 346/1.1 |
| 4,838,535 | 6/1989 | Yokoi et al. | 271/171 X |
| 4,968,016 | 11/1990 | Koyama | 271/162 X |
| 4,995,601 | 2/1991 | Ohashi et al. | 271/171 X |
| 5,026,042 | 6/1991 | Miller | 271/119 |

FOREIGN PATENT DOCUMENTS

| | | | |
|---|---|---|---|
| 838566 | 8/1976 | Belgium . | |
| 0363077 | 4/1990 | European Pat. Off. . | |
| 386737 | 9/1990 | European Pat. Off. | 271/121 |
| 53-121370 | 10/1978 | Japan | 271/119 |
| 58-6633 | 2/1983 | Japan . | |
| 58-47733 | 3/1983 | Japan | 271/119 |
| 60-25776 | 2/1985 | Japan . | |
| 60-171936 | 9/1985 | Japan | 271/162 |
| 61-55033 | 3/1986 | Japan | 271/119 |
| 63-037044 | 2/1988 | Japan . | |
| 63-196434 | 8/1988 | Japan | 271/121 |
| 63-282030 | 11/1988 | Japan | 271/119 |
| 63-67477 | 12/1988 | Japan . | |
| 2972 | 1/1989 | Japan | 271/162 |
| 214541 | 8/1989 | Japan | 271/121 |
| 236128 | 9/1989 | Japan | 271/121 |
| 43140 | 2/1990 | Japan | 271/121 |
| 75531 | 3/1990 | Japan | 271/121 |
| 138034 | 5/1990 | Japan | 271/119 |
| 2142907 | 1/1985 | United Kingdom . | |
| 2187716 | 9/1987 | United Kingdom | 271/119 |

*Primary Examiner*—William E. Terrell
*Assistant Examiner*—T. Kelly
*Attorney, Agent, or Firm*—Fitzpatrick, Cella, Harper & Scinto

[57] ABSTRACT

An automatic paper feed apparatus includes a sheet stacking device for stacking and storing a plurality of sheets, a rotary paper feed device brought into contact with the sheet to feed it, a biasing device for biasing the sheets stacked toward the rotary paper feed device, a separator having an inclined surface for bringing the sheet fed into contact with the inclined surface to separate only one sheet and supply the separated one sheet to the downstream side, and a maintaining device, brought into contact with the uppermost surface for maintaining the uppermost sheet at a position corresponding to the inclined surface against a biasing force of the biasing device.

22 Claims, 25 Drawing Sheets

XI
XII
XIII
79
80
81
83
84
85
86
87
88
89
90
93
94
51A

AUTOMATIC PAPER FEED APPARATUS

This application is a divisional of application Ser. No. 08/200,359 filed Feb. 23, 1994, now abandoned, which is a divisional of application Ser. No. 08/029,958 filed Mar. 9, 1993, abandoned, which is a continuation of application Ser. No. 07/666,922 filed Mar. 11, 1991, abandoned.

BACKGROUND OF THE INVENTION

1. Field of the Invention

The present invention relates to an automatic paper feed apparatus for separating stacked recording sheets (cut sheets) one by one and feeding each recording sheet to a process unit such as a recording unit.

2. Related Background Art

A recording apparatus such as a printer, a copying machine, or a facsimile machine is arranged to record an image on a recording sheet (recording medium) such as a paper sheet or a plastic thin sheet by selectively driving energy generation elements of a recording head. Recording apparatuses can be classified into ink-jet, wire-dot, thermal, laser beam recording systems in accordance with recording schemes. Recording sheets used in these recording apparatuses are classified into normal paper, thick paper such as a postcard or envelope, and a special sheet such as a plastic thin sheet.

Sheets can be manually fed or automatically fed by an automatic paper feed apparatus. The automatic paper feed apparatus comprises a paper feed drive unit for rotating a paper feed roller to feed out a recording sheet and a sheet stacking means for stacking the recording sheets. The paper feed drive unit is driven in synchronism with a convey system in the recording apparatus, thereby feeding the recording sheets one by one. The automatic paper feed apparatuses are also classified into a built-in paper feed apparatus and a detachable paper feed apparatus.

An automatic paper feed apparatus comprises paper feed rollers rotated together with a paper feed shaft, a sheet stacking plate on which a plurality of recording sheets can be stacked, a spring biasing means for biasing the sheet stacking plate toward the paper feed rollers to urge the recording sheet to the paper feed rollers, and a separating means consisting of an ascending surface formed in front of the paper feed direction of the paper feed rollers.

In an automatic paper feed apparatus using the above separating means, the stacked sheets must always be kept in tight contact with the paper feed rollers unlike an apparatus using separation grippers due to the following reason. When a contact force is short or becomes absent, the second and subsequent sheets float and ride on the ascending surface, and it is difficult to separate the sheets one by one. In addition, the second and subsequent sheets tend to be moved together with the sheet fed by the convey means in the recording apparatus, thereby causing multiple or double sheet feeding.

On the other hand, in order to properly feed each recording sheet by a convey roller in the recording apparatus, a frictional resistance (brake) must be eliminated or reduced upon stopping of the paper feed rollers.

In a conventional automatic paper feed apparatus of this type, in order to satisfy the above conditions, a one-way clutch is arranged in a driving force transmission mechanism (transmission mechanism) for the paper feed rollers. Prior publication which disclose this technique are exemplified by Japanese Patent Publication No. 58-6633, Japanese Laid-Open Patent Application No. 60-25776, and Japanese Patent Publication No. 63-67477.

In an arrangement including this one-way clutch, the structure becomes complicated and bulky at high cost.

SUMMARY OF THE INVENTION

The present invention has been made in consideration of the above situation, and has as its object to provide an automatic paper feed apparatus which does not require a complicated structure such as a one-way clutch in the paper feed roller drive system to obtain a simple, inexpensive arrangement even if the inclined surface separating means is used, thereby allowing separation of the stacked sheets one by one, and, at the same time, which can smoothly feed a recording sheet even during stopping of paper feed rollers.

According to the present invention, since a paper feed roller comprises a semi-circular roller having equi- and nonequi-radial sectional surfaces, and a free rotation roller having a radius slightly smaller than that of the equi-radial sectional surface is arranged adjacent to the paper feed roller, there is provided an automatic paper feed apparatus which does not require a complicated structure such as a one-way clutch in a paper feed roller drive system to obtain a simple, compact, inexpensive structure for properly separating the stacked sheets one by one, and at the same time which can smoothly feed a recording sheet even during stopping of the paper feed rollers.

According to the present invention, since the paper feed roller comprises the semi-circular roller having the equi- and nonequi-radial sectional surfaces, and the free rotation roller having the radius slightly smaller than that of the equi-radial sectional surface is arranged adjacent to the paper feed roller, there is provided the automatic paper feed apparatus which does not require the complicated structure such as the one-way clutch in a paper feed roller drive system to obtain a simple, compact, inexpensive structure for properly separating the stacked sheets one by one, and at the same time which can smoothly feed a recording sheet even during stopping of the paper feed rollers.

DETAILED DESCRIPTION OF THE PREFERRED EMBODIMENTS

The present invention will be described in detail with reference to the accompanying drawings. The first embodiment will be described with reference to FIGS. 1 to 19.

Figure 1:
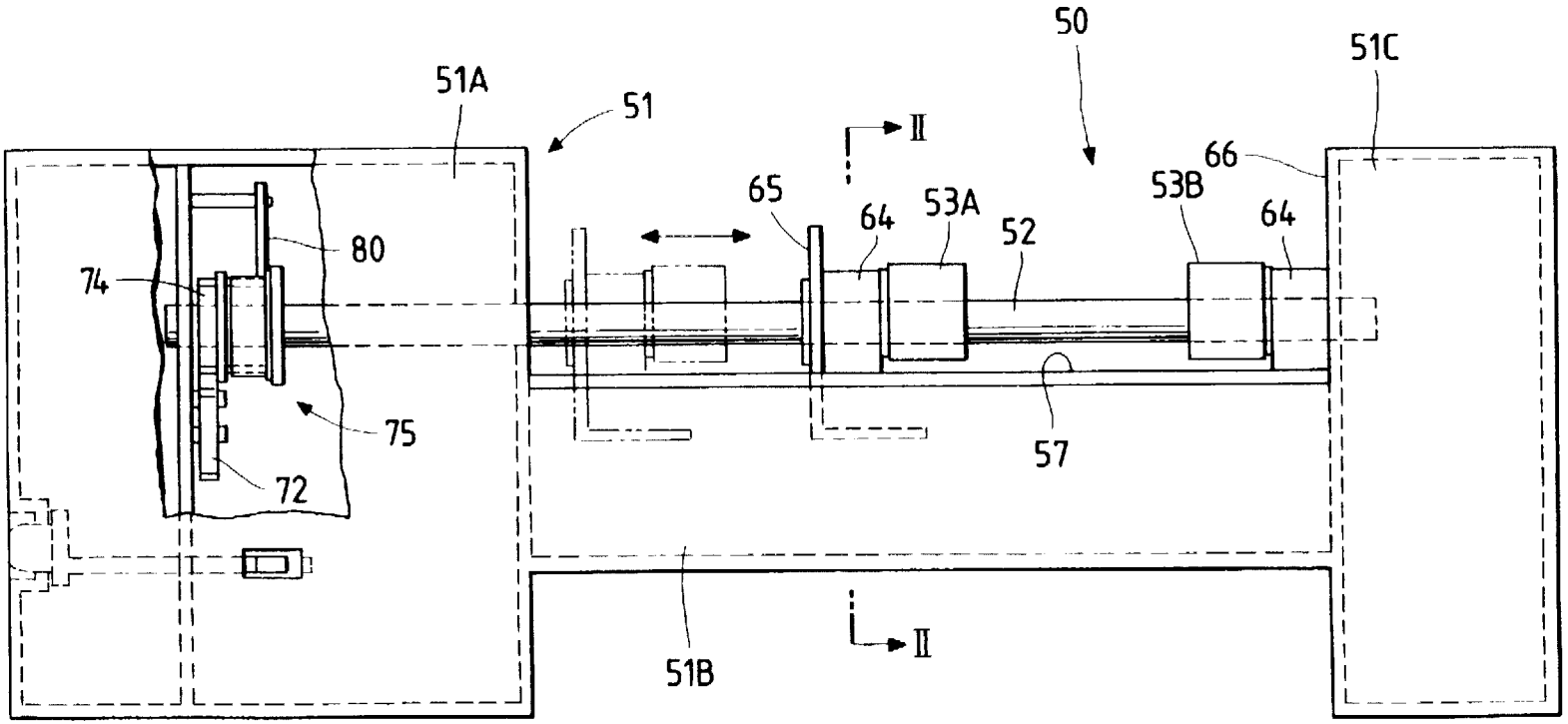
FIG. 1 is a partially cutaway front view of an automatic paper feed apparatus according to the first embodiment of the present invention.
Figure 2:
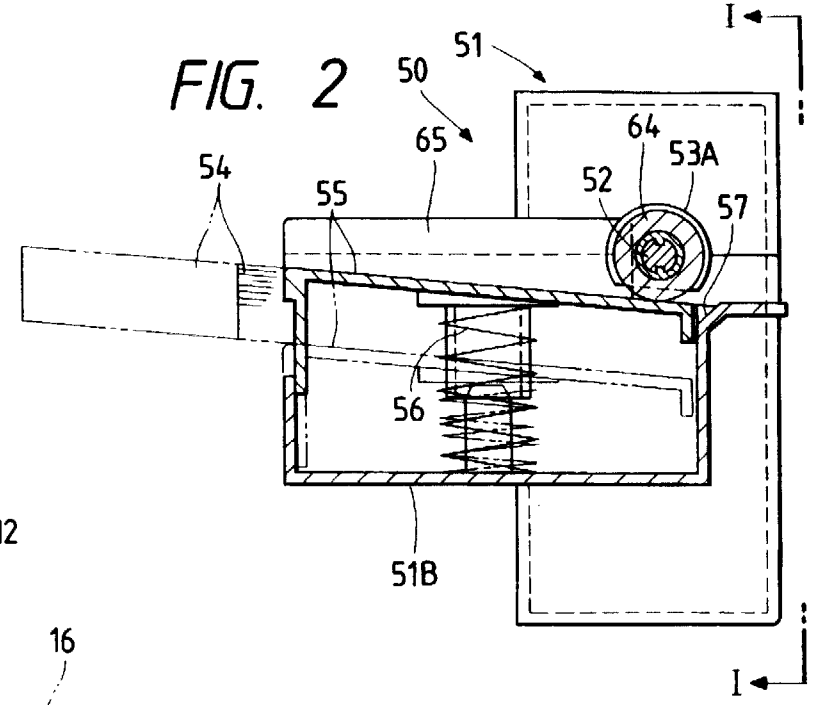
FIG. 2 is a sectional view of the automatic paper feed apparatus in FIG. 1 along the line II—II thereof.
Figure 3:
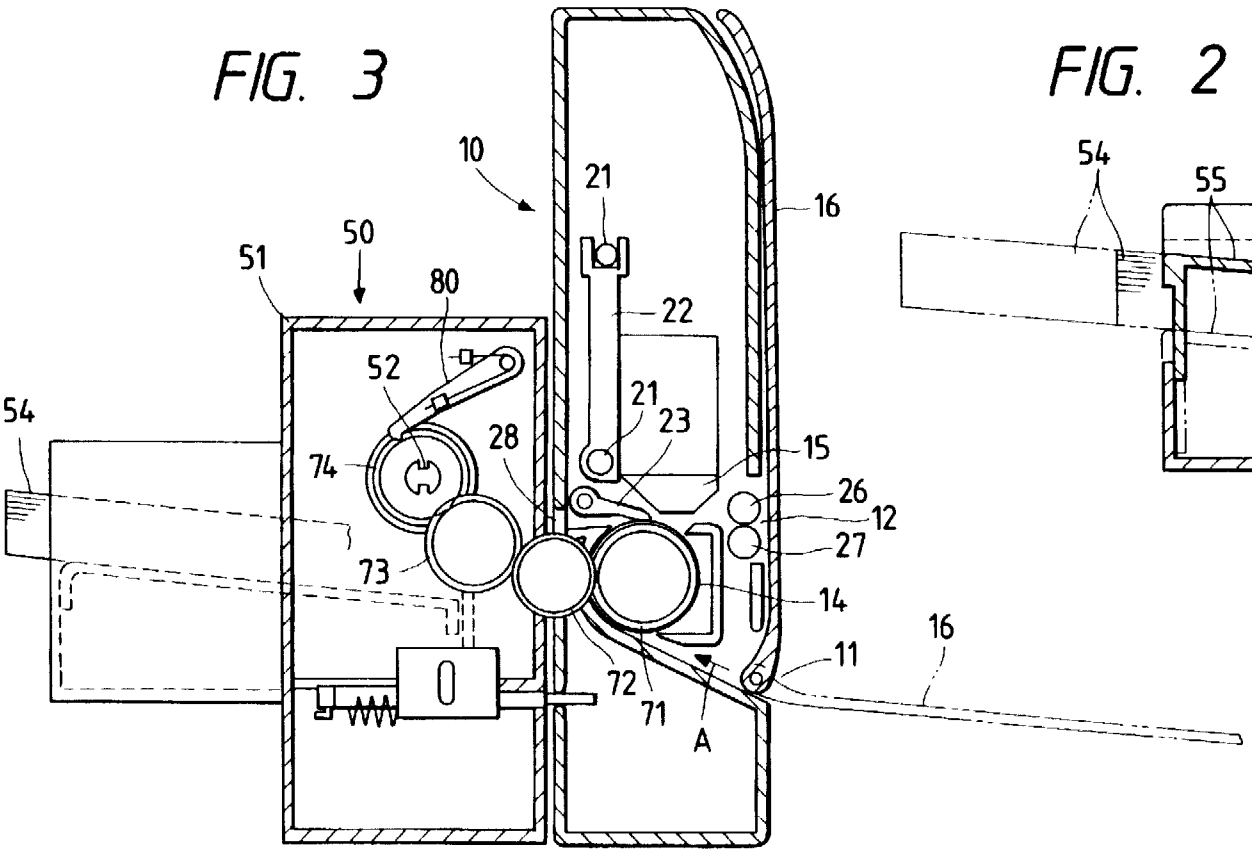
FIG. 3 is a sectional view showing a state wherein the automatic paper feed apparatus shown in FIG. 1 is mounted on a recording apparatus.
Figure 4:
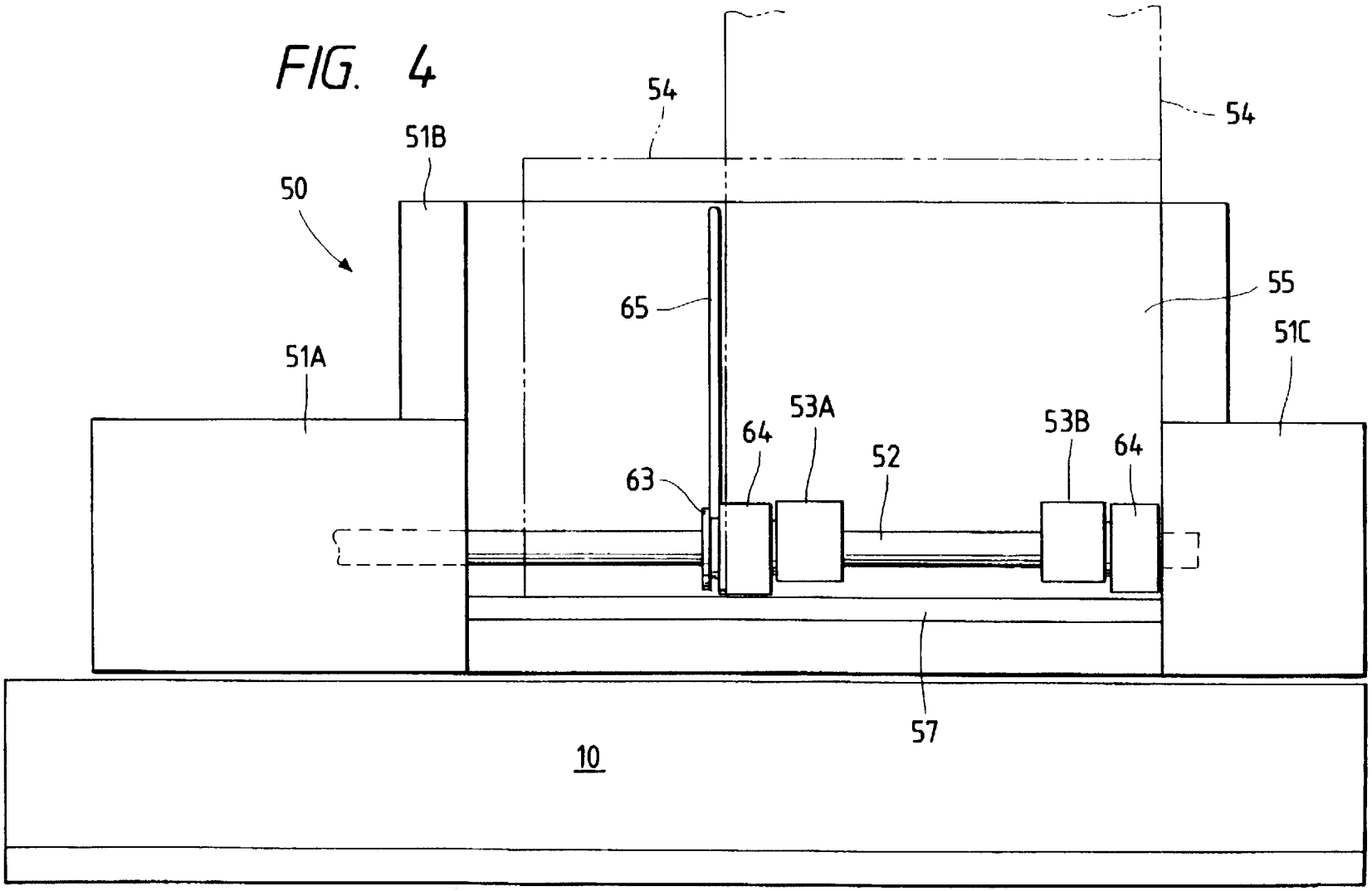
FIG. 4 is a plan view of the state of FIG. 3.

FIG. 1 is a front view of an automatic paper feed apparatus according to the first embodiment of the present invention when viewed from the line I—I of FIG. 2. FIG. 2 is a sectional view of the apparatus along the line II—II in FIG. 1. FIG. 3 is a sectional view showing a state wherein the automatic paper feed apparatus shown in FIG. 1 is mounted on a recording apparatus, and FIG. 4 is a plan view of the apparatus shown in FIG. 3.

Referring to FIGS. 1 to 4, a frame 51 of an automatic paper feed apparatus 50 is a single unit. A gear box portion 51A is formed in the left portion of the frame 51, a stacking plate support portion 51B is formed at the central portion of the frame 51, and a cover portion 51C is formed in the right portion of the frame 51.

A paper feed shaft 52 passes above the sheet stacking plate support portion 51B, and both end portions of the paper feed shaft 52 are rotatably supported by the gear box portion 51A and the cover portion 51C. Two paper feed rollers 53A and 53B are mounted on the paper feed shaft 52 so as to be rotated together therewith. In the illustrated structure, the paper feed roller 53A is mounted to be movable along the shaft 52 in a direction of sheet width, while the roller 53B is fixed on the shaft 52.

A sheet stacking plate 55 capable of stacking a plurality of recording sheets (cut sheets) 54 can be vertically movably held on the sheet stacking plate support portion 51B. The sheet stacking plate 55 is biased by an urging spring 56 (FIG. 2) mounted between the frame 51 and the sheet stacking plate 55, so that the sheet stacking plate 55 is urged toward the paper feed rollers 53A and 53B. Therefore, the recording sheets 54 stacked on the sheet stacking plate 55 are always biased by the spring 56 toward the paper feed rollers 53A and 53B.

When sheets having different sizes are used as the recording sheets 54, or when sheets having the same size are fed in a widthwise or longitudinal direction, the position of the paper feed roller 53A is adjusted together with a sheet guide 65 (to be described later).

A separating means 57 consisting of an ascending surface on which the uppermost recording sheet 54 can ride is formed in front of the paper feed rollers 53A and 53B toward the paper feed direction, or at a position adjacent to the front end of the sheet stacking plate 55. In this embodiment, the separating means 57 is formed in part of the frame 51.

Each of the paper feed rollers 53A and 53B comprises a semi-circular roller having a semi-circular shape (or D shape) having equi- and nonequi-radial surfaces. The equi-radial sectional surface is a circumferential surface brought into contact with the recording sheet 54 to feed it, while the nonequi-radial sectional surface is a circumferential surface kept separated from the recording sheet 54 within a predetermined angular interval of a paper feed wait position (reference or initial position) as the central position.

The automatic paper feed apparatus 50 of this embodiment is detachably mounted on a recording apparatus 10 and is driven by a power from a convey roller drive source of the recording apparatus 10.

Figure 6:
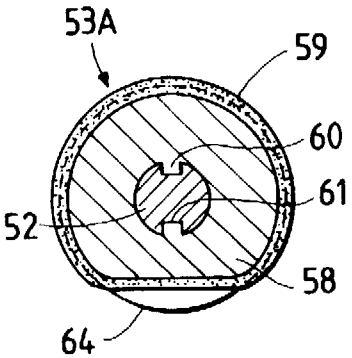
FIG. 6 is a sectional view of the structure along the line VI—VI in FIG. 5.
Figure 5:
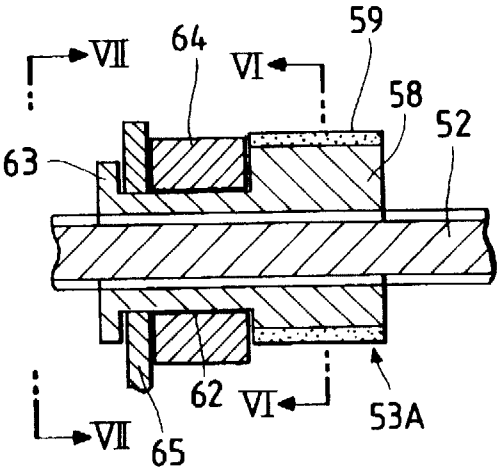
FIG. 5 is a longitudinal sectional view showing a detailed structure of a paper feed roller and a free rotation roller shown in FIG. 1.

FIG. 5 is a longitudinal sectional view of the paper feed roller 53A on the paper feed shaft 52. FIG. 6 is a sectional view of the portion along the line VI—VI of FIG. 5, and FIG. 7 is a sectional view of the structure along the line VII—VII of FIG. 5.

Figure 7:
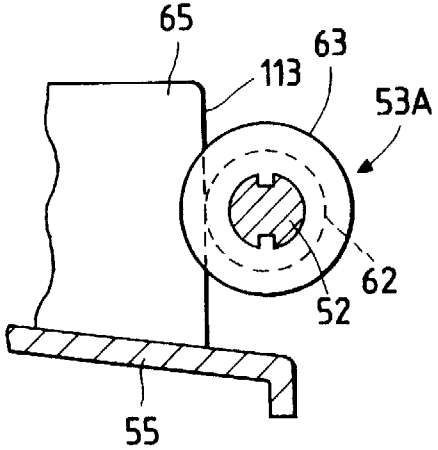
FIG. 7 is a sectional view of the structure along the line VII—VII in FIG. 5.

Referring to FIGS. 5 to 7, the paper feed roller 53A comprises a boss portion 58 made of a hard plastic material or the like and fitted in the paper feed shaft 52 and a rubber layer 59 bonded to the outer surface of the boss portion 58 by an adhesive. The rubber layer 59 constitutes the equi-radial sectional surface for generating a feed force and the nonequi-radial sectional surface which is kept separated from the recording sheet 54. The sectional shape of the rubber layer 59 is a semi-circular or D shape obtained by partially cutting an arc by a chord.

Axial projections 60 formed on the inner circumferential surface of the boss portion 58 are respectively engaged with and fitted in axial grooves 61 formed in the paper feed shaft 52, so that the boss portion 58 can be rotated together with the paper feed shaft 52 and can be slid within a predetermined axial range. A cylindrical portion 62 coaxial with the paper feed shaft 52, extending in the axial direction, and having a diameter smaller than that of the paper feed roller portion, and a flange portion 63 for preventing removal of a distal end portion of the cylindrical portion 62 are formed integrally with the boss portion 58.

A free rotation roller 64 coaxial with the cylindrical portion 62 and having a shape of a true circle are rotatably fitted on the circumferential surface of the cylindrical portion 62. The outer diameter of the free rotation roller 64 is slightly smaller than the outer diameter (equi-radial sectional surface) of the paper feed roller 53A but is larger than a notched portion (nonequi-radial sectional surface) of the paper feed roller. The free rotation roller 64 is made of a material such as a hard plastic material having a relatively small frictional coefficient.

A distal end portion 113 (FIGS. 18 and 19) of the sheet guide 65 for guiding a side edge of the recording sheet 54 passes through a space between the flange portion 63 and the end face of the free rotation roller 64 and is engaged with the cylindrical portion 62 of the boss portion 58 of the paper feed roller 53A, so that a sheet width can be adjusted. As will be described with reference to FIGS. 18 and 19, the sheet guide 65 is slidable along the sheet stacking plate 55 within a predetermined range of the sheet width. Since the sheet guide 65 can be moved along directions (i.e., vertical direction in the illustration) to come close to or to be separated from the paper feed roller 53B together with the sheet stacking plate 55, the distal end portion 113 engaged with the flange portion 63 is vertically formed to be optimally engaged with the flange portion 63 regardless of the vertical position (i.e., the stacking height of the recording sheets 54) of the sheet stacking plate 55.

The right paper feed roller 53B and the free rotation roller 64 in FIG. 1 are fixed on the paper feed shaft 52 at predetermined positions, so that a symmetrical arrangement with the paper feed roller 53A described above can be obtained. Since the paper feed roller 53B is fixed on the paper feed roller 52, the flange portion 63 and the sheet guide 65 are omitted from the illustrated arrangement, and the same function as these members can be obtained by the inner wall surface of the cover portion 51C of the frame 51.

The right paper feed roller 53B may be movable and may be arranged together with the right free rotation roller 64 and the sheet guide 65 or equivalent members, thereby obtaining a symmetrical arrangement.

The automatic paper feed apparatus 50 of this embodiment is detachably mounted on the recording apparatus 10 and is synchronously driven by a sheet convey roller by using a drive source (e.g., a motor for the sheet convey means drive source) of the recording apparatus 10. The recording apparatus 10 is vertically set, as shown in FIG. 3, when the automatic paper feed apparatus 50 is mounted thereon. When the recording apparatus is singly used, i.e., when the automatic paper feed apparatus 50 is not mounted on the recording apparatus, the recording apparatus 10 can be horizontally set, as shown in FIG. 8.

A schematic arrangement of the recording apparatus 10 will be described with reference to FIGS. 3 and 8.

Figure 8:
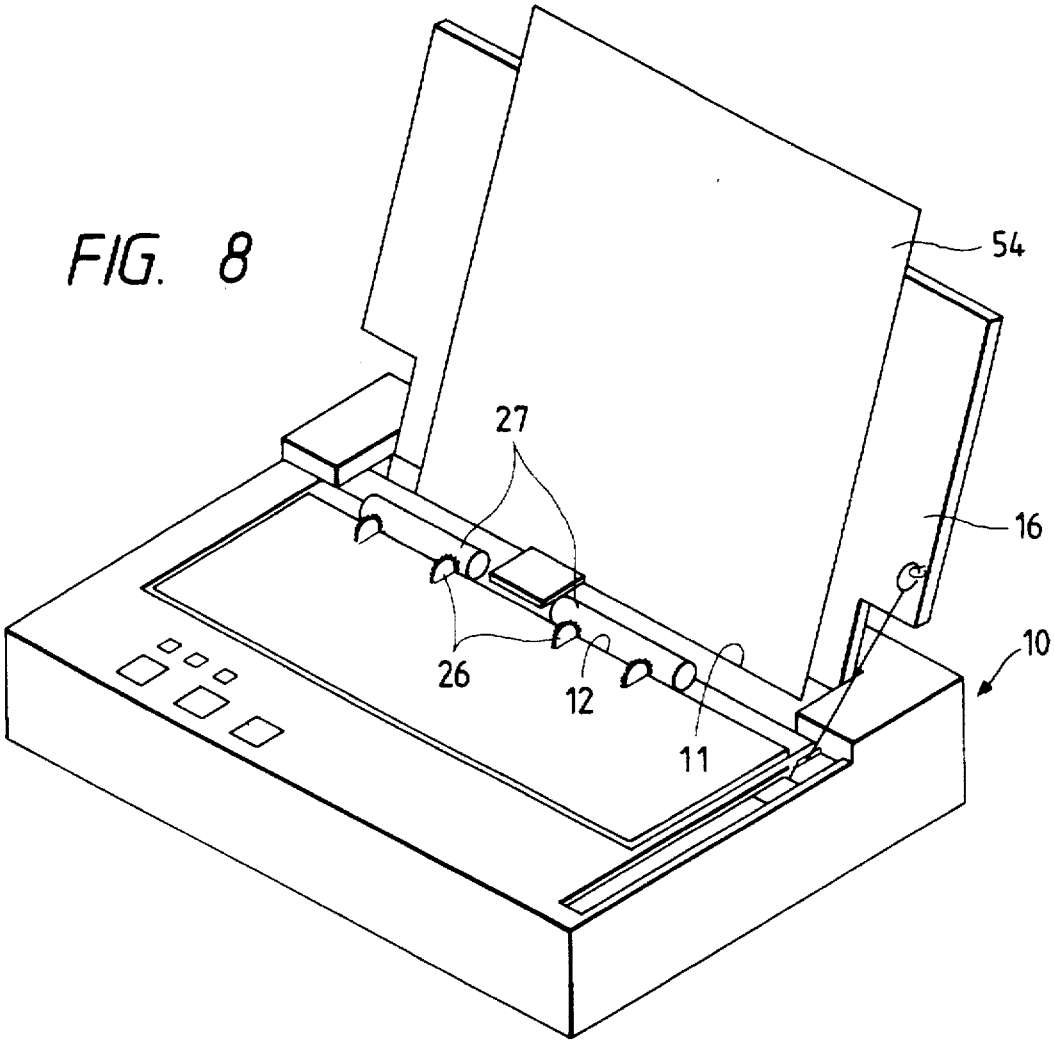
FIG. 8 is a perspective view illustrating a state wherein the recording apparatus shown in FIG. 3 is laterally located.

Referring to FIGS. 3 and 8, a sheet insertion port 11 and a sheet discharge port 12 are formed in the upper surface (i.e., the front surface in an upright state) of the recording apparatus 10. A recording sheet inserted into the sheet insertion port 11 is brought into tight contact with the circumferential surface of a platen roller 14 which also serves as a sheet convey roller and is fed in a direction of an arrow A along a substantially U-shaped recording sheet convey path. An image is recorded on the recording sheet while the recording sheet passes through a recording unit facing a recording head 15. The recording sheet is then discharged upward (the front surface in the upright state) from the sheet discharge port 12.

A paper feed tray 16 is pivotally supported on the upper surface of the recording apparatus 10 so as to be closed or opened. When the recording apparatus is used (i.e., in the recording mode), the paper feed tray 16 is open and serves as a paper feed tray. However, when the recording apparatus is not used (storage state), the paper feed tray 16 is set in the closed position, as indicated by the solid line in FIG. 3. In this case, the paper feed tray 16 serves as a cover 16 for protecting the sheet insertion port 11, the sheet discharge port 12, and the upper surface of the recording apparatus which has switches and display elements.

Referring to FIG. 3, the recording head 15 is mounted on a carriage 22 reciprocated along the platen roller 14 and parallel guide shafts 21. The illustrated recording head 15 is an ink-jet head incorporating an ink tank.

A sheet press member 23 for pressing the recording sheet on the platen roller 14, is arranged in the upstream of the recording head 15 along the feed direction. The sheet press member 23 is brought into tight contact with the outer surface of the platen roller 14 by a spring (not shown). An urging force of the sheet press member 23 can be released upon operation of a lever. Spur gears 26 and paper discharge rollers 27 which assist discharge of the recording sheet are disposed at the sheet discharge port 12.

Figure 14:
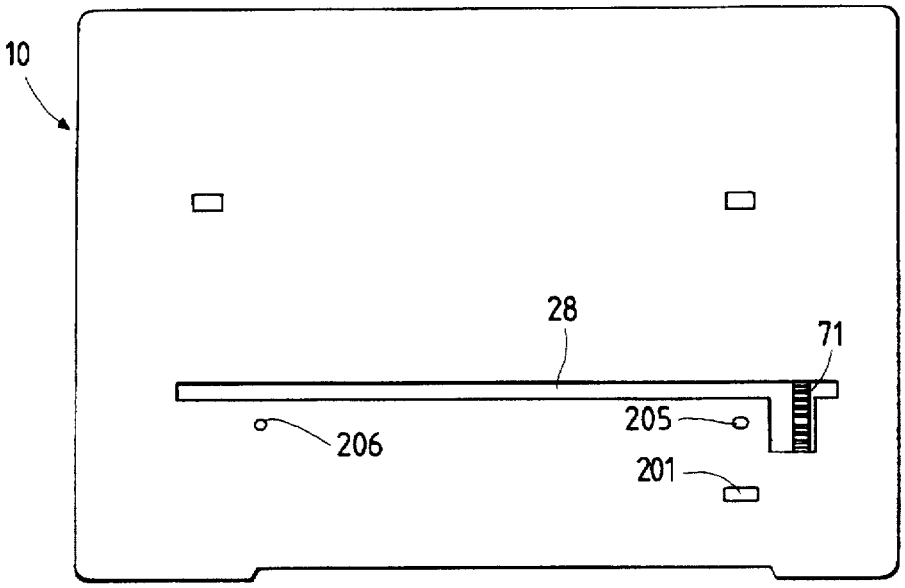
FIG. 14 is a rear view showing the automatic paper feed apparatus on the recording apparatus in FIG. 3.

FIG. 14 is a view showing a bottom surface (i.e., the rear surface to which the automatic paper feed apparatus 50 is mounted when the recording apparatus 10 is set in the upright state).

A second sheet insertion port 28 is formed in the rear surface of the recording apparatus 10. A second recording sheet convey path almost linearly extending from the insertion port 28 to the sheet discharge port 12 through the recording unit located between the recording head 15 and the convey roller (platen roller) 14 extends in an almost horizontal direction. The second recording sheet convey path is used when the recording apparatus 10 is set in the upright state. Since the second recording sheet convey path is not curved, a rigid recording sheet such as a thick sheet (e.g., a postcard or envelope) or a special sheet (e.g., a plastic sheet) can be easily fed.

In the upright state, as shown in FIGS. 3 and 4, the automatic paper feed apparatus 50 is detachably mounted on the recording apparatus 10, and the recording sheets 54 are fed from the sheet insertion port 28 of the rear surface (upright state) one by one. The automatic paper feed apparatus 50 is positioned to feed the recording sheet from the inlet (sheet insertion port) 28 to the linear convey path and is detachably mounted on the rear surface (i.e., the opening surface of the inlet 28) of the recording apparatus 10. When the automatic paper feed apparatus 50 is mounted on the recording apparatus 10, the paper feed tray 16 is set at an open position, as indicated by the alternate long and two short dashed line in FIG. 3, and is used as a paper discharge tray.

The recording sheet 54 fed from the automatic paper feed apparatus 50 through the sheet insertion port 28 is fed and gripped between the convey roller 14*a* and the sheet press member 23 and is fed to the paper feed position (normally, a regist position) by the convey roller 14 and the paper feed roller 53 synchronously rotated with the convey roller 14.

When the semi-circular feed roller 53 returns to the initial position and the sheet feed force is released, a recording operation is started. An image is recorded on the recording sheet 54 while the recording sheet 54 is being fed by the convey roller 14.

The recording sheet 54 fed by the convey roller 14 is fed between the paper discharge rollers 27 and the spur gears 26. Thereafter, the recording sheet is fed by the convey roller 14 and the paper discharge rollers 27 synchronously driven with the convey roller 14. The discharge rollers 27 is synchronously driven at almost the same peripheral speed as that of the convey roller 14. In the subsequent recording operation, the recording sheet 54 is conveyed by the convey roller 14 and the paper discharge rollers 27. The recorded sheet 54 is discharged onto the paper feed tray 16 which also serves as the paper discharge tray.

When the recording sheet 54 is discharged or fed by the convey roller 14 or both the convey roller and paper discharge rollers 27, the recording sheet 54 is kept in tight contact with only the free rotation roller 64 even in the presence of the recording sheet 54 in the automatic paper feed apparatus 50. In this state, since the recording sheet 54 is kept separated, from the paper feed roller 53, the recording sheet 54 can almost be freely pulled without any resistance, thereby eliminating the brake function at the time of recording sheet feeding. Multiple sheet feed (double feed) can also be prevented.

In the state wherein the automatic paper feed apparatus 50 is mounted on the recording apparatus 10, a gear (i.e., an output gear from the recording apparatus 10) fixed on the shaft of the sheet convey roller 14 is meshed with an input gear 72 arranged in the gear box 51A of the automatic paper feed apparatus 50 (see FIGS. 1 and 3). Therefore, the input gear 72 is driven in synchronism with sheet feeding of the recording apparatus 10. Rotation of the input gear 72 is transmitted to a gear (clutch gear) 74 on the paper feed shaft 52 through a gear 73. A one-rotation spring clutch 75 is arranged between the gear 74 and the paper feed shaft 52. This one-rotation spring clutch 75 is operated as follows. Upon slight reverse rotation (i.e., rotation in a direction opposite to the feed direction) of the sheet convey roller (platen roller) 14 performed on the basis of a paper feed signal, the one-rotation spring clutch 75 is rotated in the reverse direction at the reference or initial position where the paper feed roller 53 is kept separated from the recording sheet 54. By this reverse rotation, engagement with a control means such as a control lever (hook) for preventing recording rotation is released, so that the spring clutch 75 is switched from an OFF state to an ON state. Even if the paper feed roller 53 is kept separated from the recording sheet 54, the free rotation roller 64 having a shape of a true circle is kept in contact with the recording sheet 54.

In a clutch ON state, upon rotation of the paper feed roller (D-shaped or semi-circular roller) 53 in synchronism with rotation of the convey roller (platen roller) 14 by a predetermined amount in the recording direction, only one recording sheet 54 is separated from the remaining sheets and is fed to the position exceeding a sheet receiving portion of the platen roller 14. When the roller 53 returns to the initial position (i.e., a position where a gap is formed between the paper feed roller 53 and the recording sheet 54), the control means is locked at a position for preventing rotation in the recording direction, and the spring clutch 75 is turned off. The platen roller 14 is disconnected from the paper feed roller 53, thereby stopping the paper feed roller 53. Therefore, only one recording sheet 54 is separated and fed during one revolution of the paper feed roller 53 (paper feed shaft 52).

Figure 9:
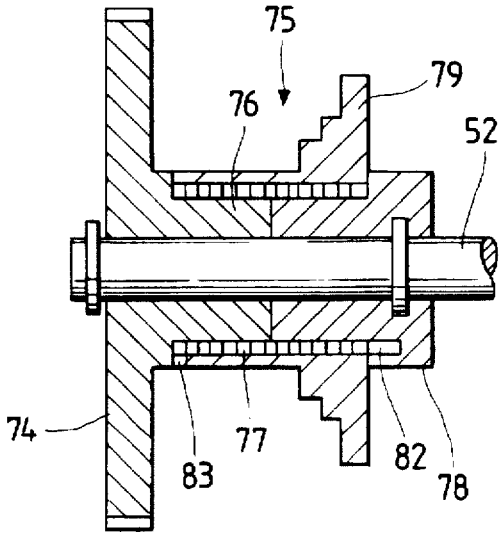
FIG. 9 is a longitudinal sectional view showing a detailed structure of a one-rotation spring clutch shown in FIG. 1.

FIG. 9 is a longitudinal sectional view showing a structure of the one-rotation spring clutch 75. FIGS. 10 to 13 are views for explaining a control lever (control means) and a control ring shown in FIG. 9.

The one-rotation spring clutch 75 mounted on the paper feed shaft 52 comprises a boss portion (winding body) 76 integrally formed with the clutch gear (input gear) 74, a clutch coil spring 77, a clutch drum 78, and a control ring 79. As shown in FIGS. 10 to 13, a control means (control lever) 80 for controlling a clutch operation is axially and radially inwardly urged by a control spring 81. The clutch drum 78 is fixed on the paper feed shaft 52 and is rotated together therewith.

The clutch gear 74 having the boss portion 76 is rotatably fitted on the paper feed shaft 52. Clutch spring seat portions are formed on the circumferential surface portions of the boss portion 76 and the clutch drum 78. The clutch coil spring 77 is bridged between the boss portion 76 and the clutch drum 78. One end of the clutch coil spring 77 is engaged with a hole 82 formed in the clutch drum 78 and is always connected to the clutch drum 78. The other end of the clutch coil spring 77 is hooked by a notch 83 formed in the control ring 79 rotatably fitted on the outer surface of the clutch coil spring 77.

Figures 10, 11, 12, 13:
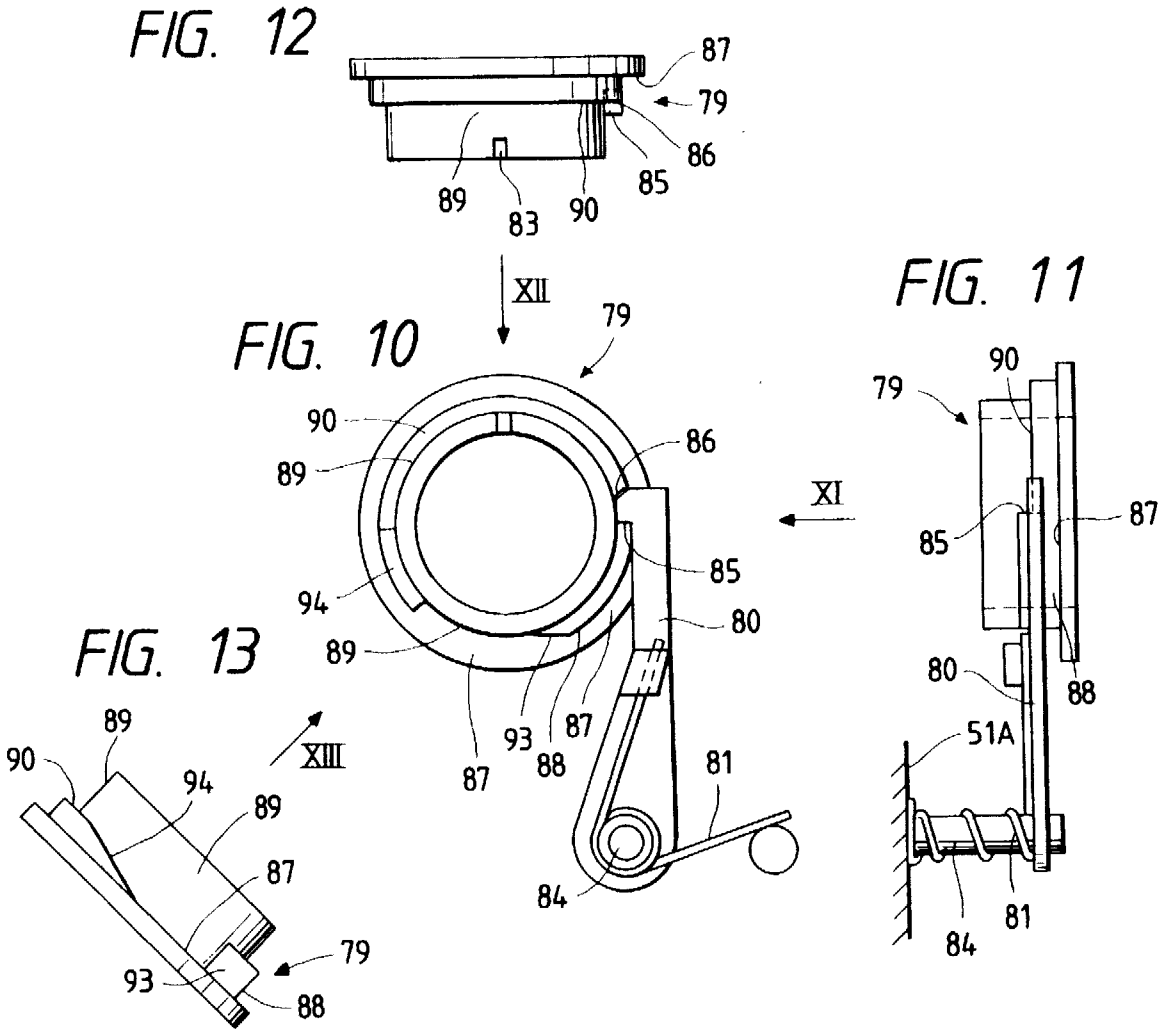
FIG. 10 is a front view of a control ring and a control lever in FIG. 9.
FIG. 11 is a side view of the structure when viewed from the line XI in FIG. 10.
FIG. 12 is a side view of the control ring when viewed from the line XII in FIG. 10.
FIG. 13 is a side view of the control ring when viewed from the line XIII in FIG. 10.

The control ring 79 has a shape, as shown in FIGS. 10 to 13, and counterclockwise rotation in the plan view of FIG. 10 corresponds to the paper feed direction of the paper feed roller 53.

The control lever 80 is pivotally fitted on a shaft 84 arranged in the gear box portion 51A of the frame 51. As shown in FIGS. 10 and 11, the control lever 80 is biased axially (right direction in FIG. 11) and radially inward with respect to the control ring 79 by the control spring 81.

In a paper feed wait state (i.e., the reference noncontact position of the paper feed roller 53), the control lever 80 is hooked by a notch 85 of the control ring 79. In this state, the recording sheet 54 is kept in contact with the free rotation rollers 64.

When a paper feed command is output from a control unit, the convey roller 14 is rotated by a predetermined amount in the reverse direction. In synchronism with this rotation, the control ring 79 is rotated by a predetermined number of steps in the reverse direction (i.e., clockwise rotation) through the transmitting means (clutch gear) 74 and the clutch coil spring 77. This rotation causes reverse rotation of the convey roller 14, and the clutch coil spring 77 wound around the boss portion (winding body) 76 tends to be loosened. However, in practice, since a load such as a contact force with the recording sheet 54 is small, an initial tightening torque of the clutch coil spring 77 acts to transmit rotation of the clutch gear (transmitting means) 74. The control ring 79 hooked at the spring end of the clutch coil spring 77 is rotated by a predetermined number of steps in the reverse direction.

Upon reverse rotation of the control ring 79, the control lever 80 is moved radially outward along an inclined surface portion 86 of the notch 85 of the control ring 79. When the control lever 80 rides on a surface 88, it is urged against a surface 87 by the control spring 81. Therefore, the control lever 80 slides along the surfaces 87 and 88.

The control ring 79 is rotated by about one revolution in the forward direction. More specifically, when the clutch gear 74 is rotated in the forward direction in synchronism with rotation of the convey roller 14, the clutch coil spring 77 wound around the boss portion 76 is rotated in a tightening direction, so that the boss portion 76, the clutch coil spring 77, and the clutch drum 78 are rotated together. The torque is transmitted to the paper feed shaft 52 and the paper feed roller 53. At the same time, the control ring 79 engaged with one end of the clutch coil spring 77 is rotated in the same direction.

By this rotation and a biasing force of the control spring 81, the control lever 80 is moved onto the surface 88 and is then urged toward the surface 87. Therefore, the control lever 80 can be smoothly slid along the surfaces 87 and 88. By this rotation in the forward direction, the paper feed roller 53 is driven to start feeding the recording sheet 54.

When the control ring 79 is rotated through a predetermined angle in the forward direction, the control lever 80 descends to a surface 89 along a descending surface 93 and is guided to contact the surface 89 by a surface 94. Further forward rotation causes the distal end of the control lever 80 to hook with the notch 85 of the control ring 79, thereby stopping the control ring 79. That is, when forward rotation through a predetermined angle is completed, the control lever 80 is descended to the surface 89 by the surface 93 and is slid by a predetermined angle along the surfaces 87 and 89.

Further forward rotation allows ascending of the control lever 80 along the surface 94, and the control lever 80 is slid along the surfaces 89 and 90. Further forward rotation by one revolution causes the control lever 80 to drop from the surfaces 89 and 90, and the control lever 80 is fitted in the notch 85 formed in the dropping position. The control lever 80 is locked in the notch 85, so that rotation of the control ring 79 is stopped. When rotation of the control ring 79 is stopped, the one-rotation spring clutch 75 is set in the clutch OFF state again.

The above operations are summarized below. Upon initial reverse rotation of the control ring 79 (a predetermined number of pulses), a paper feed trigger signal is generated for rotating the paper feed roller 53 by one revolution. The paper feed roller 53 is driven during one forward revolution of the control ring 79. When the paper feed roller 53 and the control ring 79 are rotated by one revolution and return to the initial positions, the control lever 80 is fitted in the notch 85 again to turn off the clutch. The paper feed roller 53 is stopped at the reference position.

The number of pulses of the reverse trigger signal is determined so that the control lever 80 is moved along the surface 86 of the control ring 79 and is removed from the notch 85 and moved onto the surfaces 87 and 88 when paper feed roller 53 is rotated in the reverse direction upon rotation of the convey roller drive motor of the recording apparatus 10. The number of pulses is determined so as not to cause the paper feed roller 53 to interface with other portions such as the recording sheet 54, i.e., so as not to cause operation errors such as misregistration of the sheet.

According to the one-rotation spring clutch 75 described above, since the paper feed roller 53 is controlled to perform rotation by one revolution, the recording sheet 54 is located at a position shifted more than a predetermined initial position of the recording sheet 54 in the paper feed direction, i.e., a position passing through the separating means 57. Therefore, a decrease in necessary paper feed amount in the recording apparatus 10 can be prevented.

By the range of the equi-radial sectional surface which is brought into contact with the recording sheet 54, even if paper feeding is completed unless the paper feed roller 53 is rotated by one revolution, the control ring 79 can return to the initial position. Even after rotation of the paper feed roller 53 is stopped, the drive source is kept rotated to pick up the recording sheet 54. Incomplete engagement of the control lever 80 due to a shortage of rotation of the control ring 79 can be perfectly prevented. Therefore, the control ring 79 is controlled to always return to the initial position (i.e., the position where the semi-circular or D-shaped notch opposes the recording sheet 54 without contact, and only each free rotation roller 64 is kept in contact with the recording sheet 54). For this reason, even if a paper feed error is about to occur due to misregistration of the recording sheet or its slippage, the recording sheet can be properly fed.

A connecting structure between the recording apparatus 10 and the automatic paper feed apparatus 50 detachable therefrom will be described below.

Figure 15:
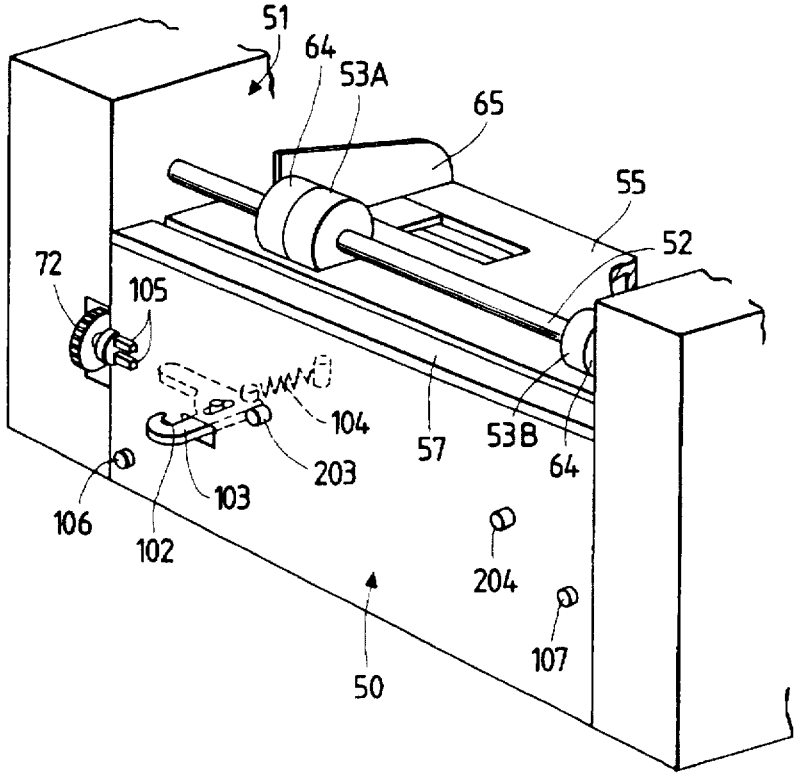
FIG. 15 is a perspective view of the automatic paper feed apparatus of FIG. 1 when viewed from the mounting surface of the recording apparatus.
Figure 16:
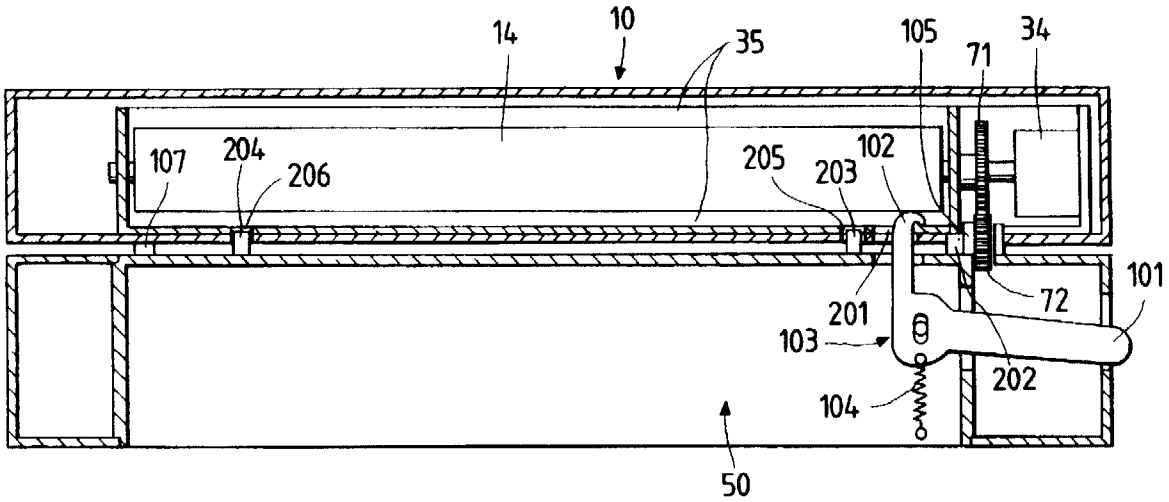
FIG. 16 is a sectional view showing the main part of a locked state of a connecting portion between the recording apparatus and the automatic paper feed apparatus shown in FIG. 3.
Figure 17:
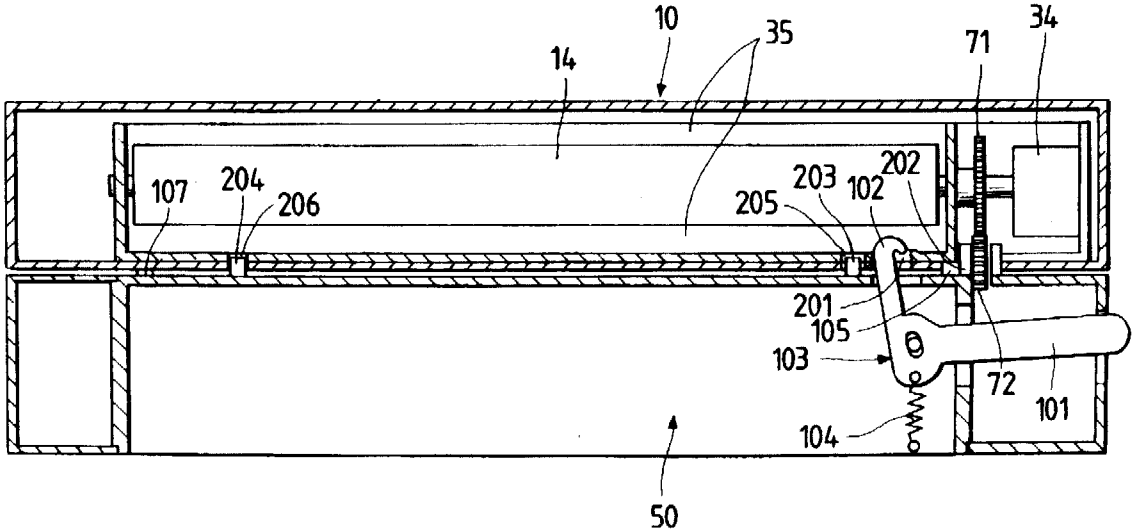
FIG. 17 is a sectional view showing the main part of a lock release state in FIG. 16.

FIG. 14 is a rear view showing an automatic paper feed apparatus mounting surface of the recording apparatus 10, FIG. 15 is a perspective view showing the mounting surface (front surface) of the automatic paper feed apparatus 50, FIG. 16 is a horizontal sectional view showing a connecting sate between the recording apparatus 10 and the automatic paper feed apparatus 50, and FIG. 17 shows an unlocked state from the state shown in FIG. 16.

As shown in FIGS. 14, 16, and 17, the output gear 71 which synchronously rotates with the platen roller 14 is axially supported on the rear surface side of the recording apparatus 10. The input gear 72 capable of transmitting a rotational force to the paper feed roller 53 (paper feed shaft 52) is axially supported on the mounting surface of the automatic paper feed apparatus 50, as shown in FIGS. 15 to 17. At the time of connection between the recording apparatus 10 and the automatic paper feed apparatus 50, the gears 71 and 72 are meshed with each other, so that a driving force of the paper feed roller 53 is transmitted to the automatic paper feed apparatus.

A frame member 35 for supporting bearing portions of the platen roller 14 and a sheet convey motor 34 is arranged in the recording apparatus 10, and a case portion is mounted on the frame member 35. A hook member 103 having a lever 101 and a hook member 103 having a distal end hook 102 are swingable and movable back and forth by a predetermined amount in the automatic paper feed apparatus 50. The hook member 103 is biased inward by a tension spring 104.

An opening 201 for receiving the hook 102 through a case opening is formed at a position corresponding to the hook 102 in the frame member 35 of the recording apparatus 10. The hook 102 is engaged with the peripheral portion of the opening 201. As shown in FIGS. 16 and 17, a rounded portion is formed at the edge of the opening 201 to facilitate smooth engagement with the hook 102.

When the hook 102 shown in FIG. 16 is engaged with the opening 201, the tension spring 104 is extended (e.g., by 1 to 2 mm), and the automatic paper feed apparatus 50 can be connected to the recording apparatus 10 by this spring force. Upon pivotal movement of the lever 101, a hook member 103 is released, as shown in FIG. 17, so that the automatic paper feed apparatus 50 can be detached from the recording apparatus 10. A connecting urging force is received at three abutment surfaces.

As shown in FIGS. 14 to 16, the automatic paper feed apparatus 50 has a first abutment surface 105 serving as a reference abutment surface, and second and third abutment surfaces 106 and 107. The reference abutment surface 105 is formed near the input gear 72, as shown in FIGS. 14 to 16. A mating reference abutment surface 202 for the reference abutment surface 105 is formed on the frame member 35 having a higher rigidity and is located near a meshing portion between the gears 71 and 72. The line of action of the hook portion 103 for applying a contact force to the connecting portion is selected to obtain a stable connection state in consideration of the three abutment surfaces 105, 106, and 107.

The second and third abutment surfaces 106 and 107 can be brought into direct contact with the rear surface of the recording apparatus 10. Positioning pins 203 and 204 are formed on the mounting surface of the automatic paper feed apparatus 50. When these pins 203 and 204 are fitted into positioning holes 205 and 206 formed in the rear surface of the recording apparatus 10, the automatic paper feed apparatus 50 can be positioned on the recording apparatus 10. The hole 205 as one of the holes 205 and 206 comprises an elongated hole, as shown in FIG. 14.

Figure 18:
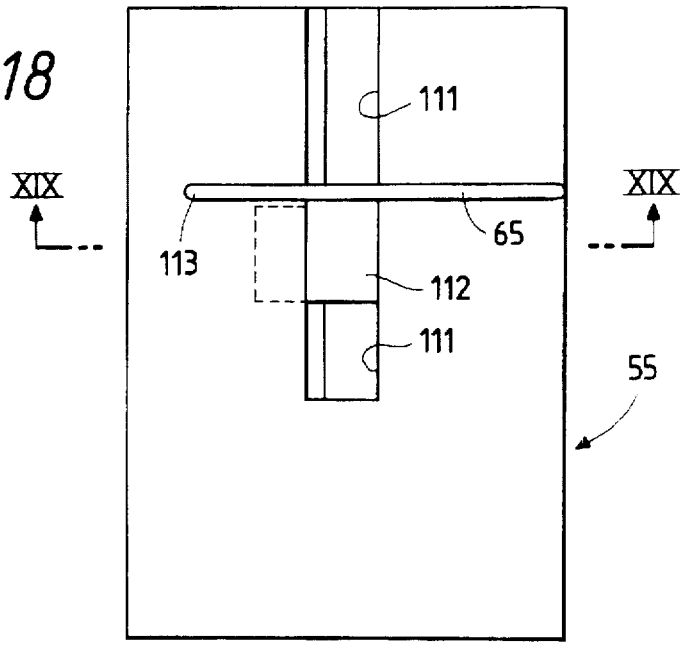
FIG. 18 is a plan view of a sheet stacking plate and a sheet guide in the automatic paper feed apparatus shown in FIG. 1.
Figure 19:
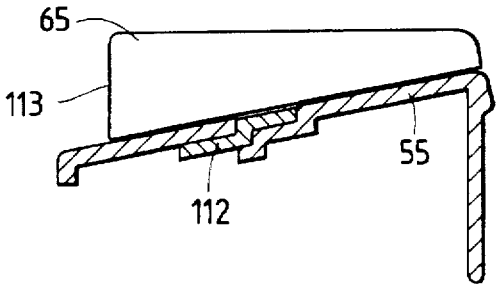
FIG. 19 is a sectional view of the structure along the line XIX—XIX in FIG. 18.

FIG. 18 is a plan view of the sheet stacking plate 55 and the sheet guide 65, and FIG. 19 is a sectional view of the structure along the line XIX—XIX of FIG. 18.

Referring to FIGS. 18 and 19, a guide groove 111 is formed in a predetermined range along the sheet widthwise direction of the sheet stacking plate 55, and an engaging portion 112 slidable along the guide groove 111 is formed in the lower portion of the sheet guide 65. As shown in FIG. 19, the upper surface of the engaging portion 112 has the same level as that of the upper surface of the sheet stacking plate 55, and the recording sheets 54 can be stacked on the identical surfaces.

The distal end portion 113 of the sheet guide 65 is engaged with the flange portion 63 (FIGS. 5 and 7). When the sheet guide 65 is moved to adjust the sheet width, the paper feed roller 53A and the free rotation roller 64 adjacent to the paper feed roller 53A are simultaneously adjusted for this positioning.

The second embodiment will be described with reference to FIGS. 20 to 26. Parts different from the first embodiment are mainly described.

Figure 21:
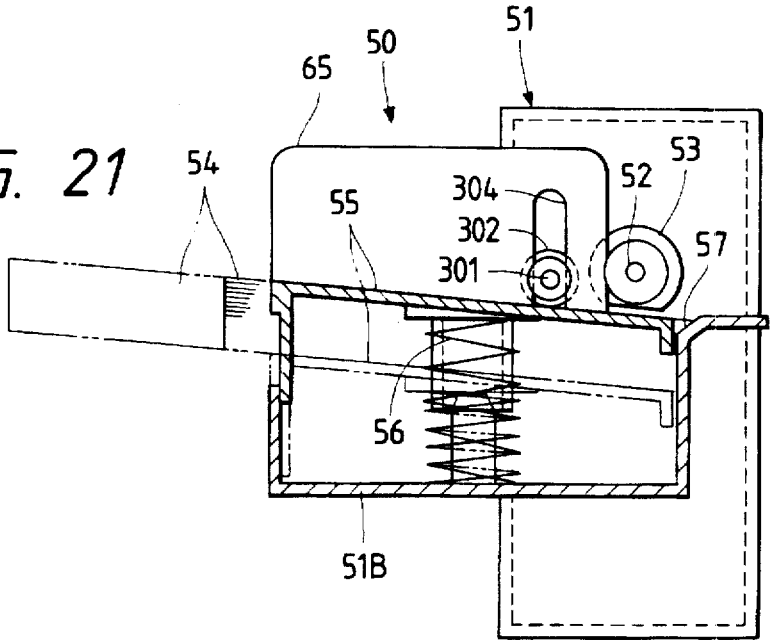
FIG. 21 is a sectional view of the apparatus along the line XXI—XXI of FIG. 20.
Figure 20:
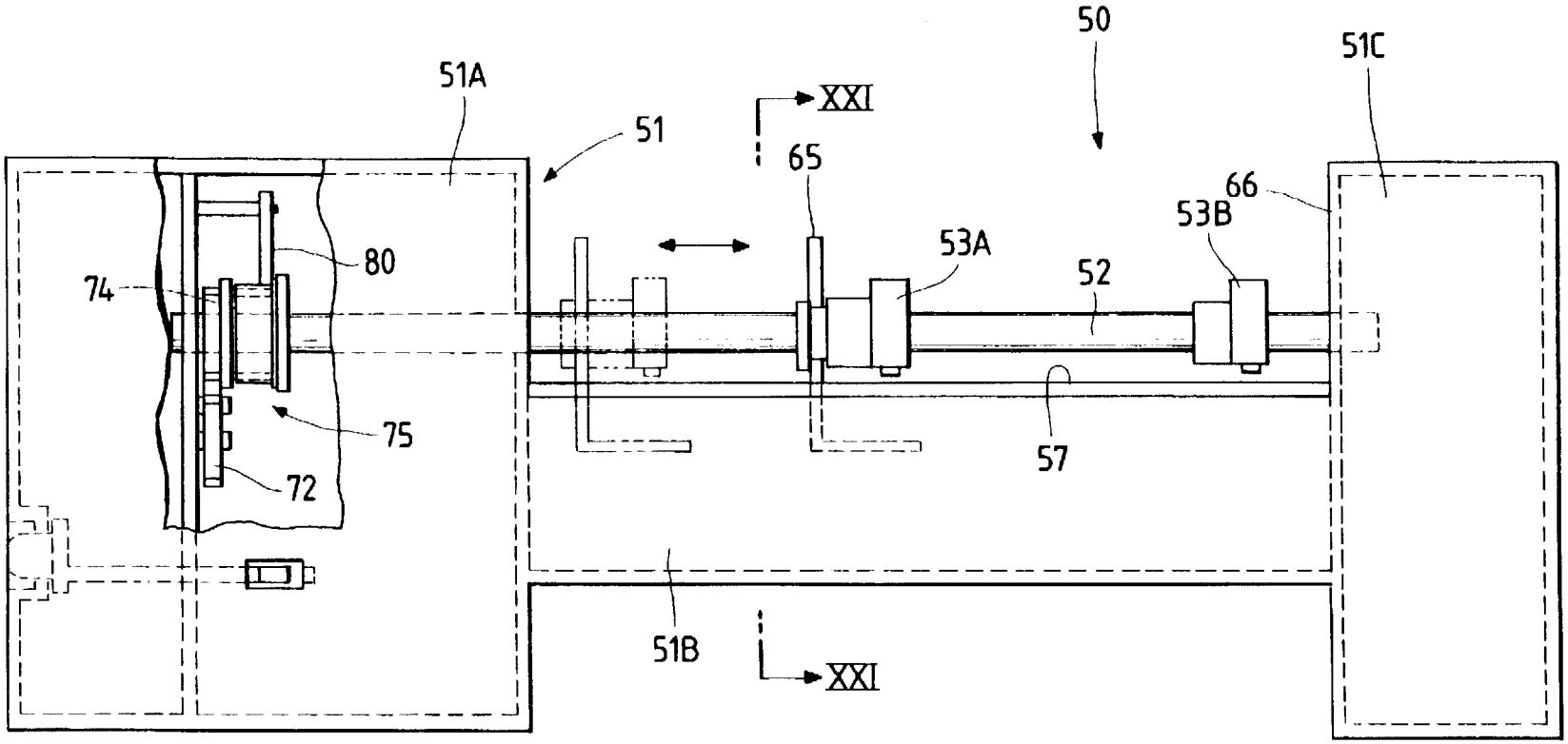
FIG. 20 is a partially cutaway front view of an automatic paper feed apparatus according to the second embodiment of the present invention.
Figure 22:
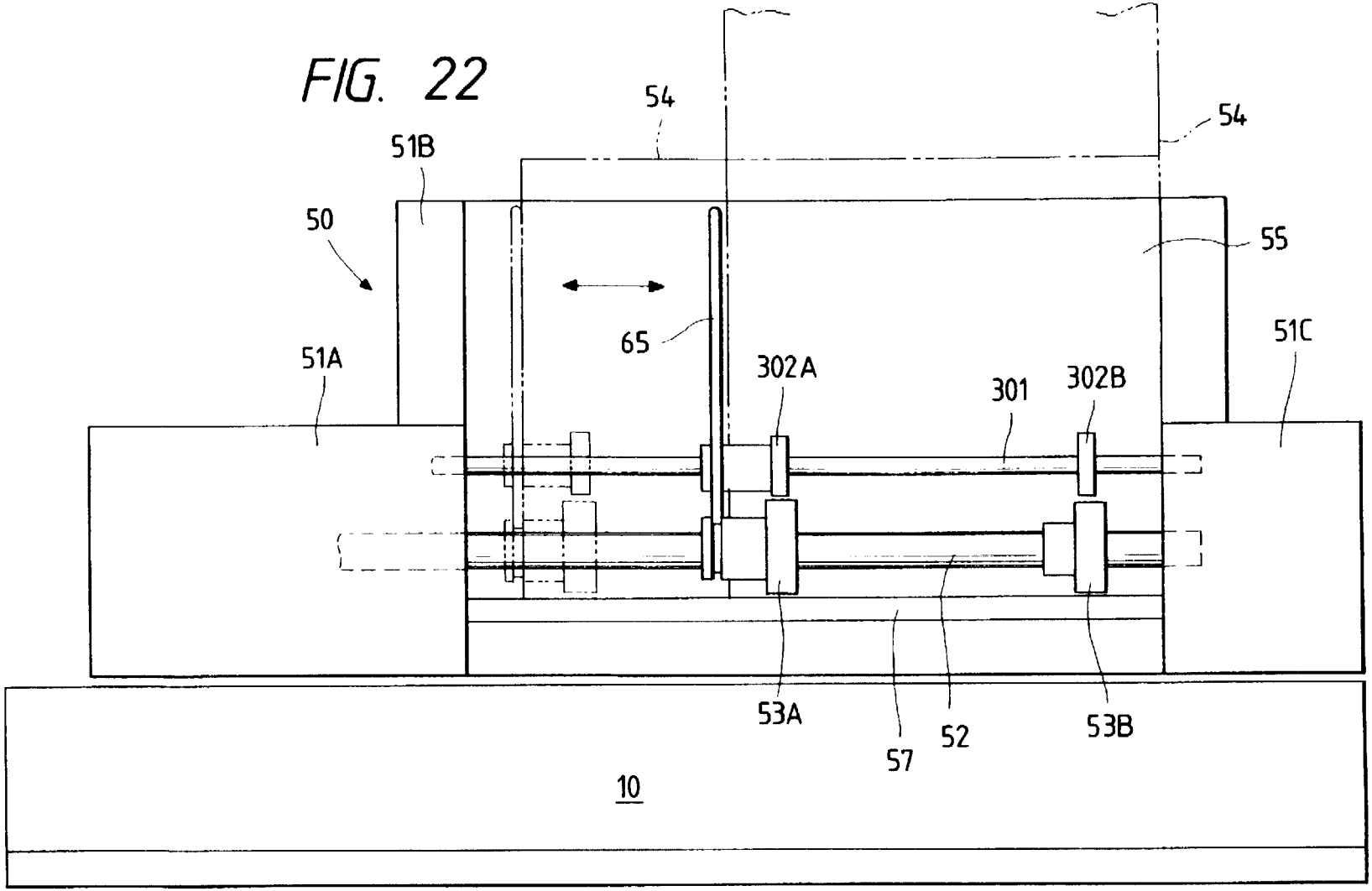
FIG. 22 is a plan view of the apparatus shown in FIG. 20.

FIG. 20 is a front view of this embodiment, FIG. 21 is a sectional view of the structure along the line XXI—XXI of FIG. 20, and FIG. 22 is a plan view of the structure of FIG. 20.

A support shaft 301 parallel to a paper feed shaft 52 is arranged behind the paper feed shaft 52 in the paper feed direction. Both end portions of the support shaft 301 are held by a gear box portion 51A and a cover portion 51C. The support shaft 301 is mounted to be normally stationary. Free rotation rollers 302A and 302B adjacent to paper feed rollers 53A and 53B are rotatably supported on the support shaft 301 at positions respectively corresponding to the rollers 53A and 53B.

The free rotation roller 302A is mounted to be moved together with the corresponding paper feed roller 53A along the shaft 301 in the sheet widthwise direction. The free rotation roller 302B is rotatable with respect to the shaft 301, but is stationary on the shaft 301 along the sheet widthwise direction.

Figure 24:
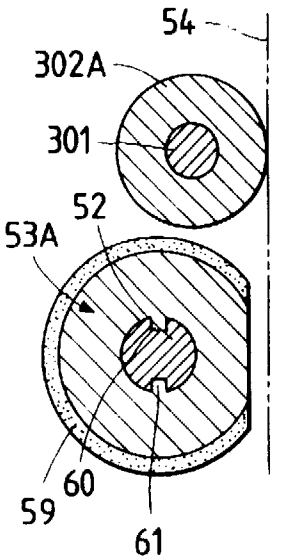
FIG. 24 is a sectional view of the structure along the line XXIV—XXIV of FIG. 23.
Figure 23:
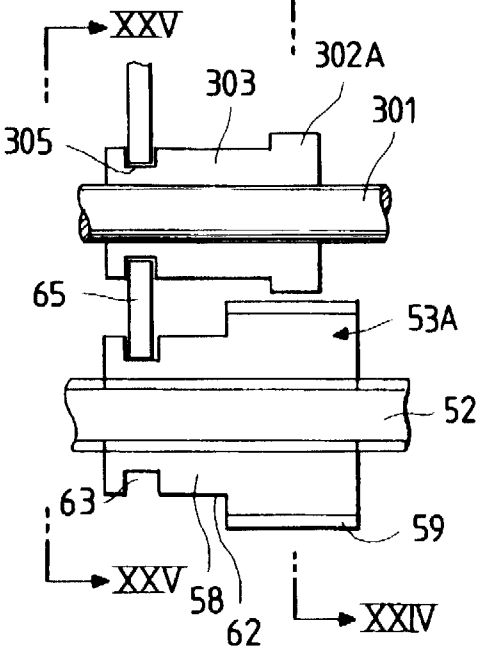
FIG. 23 is a horizontal sectional view showing a detailed structure of a paper feed roller and a free rotation roller in FIG. 20.
Figure 26:
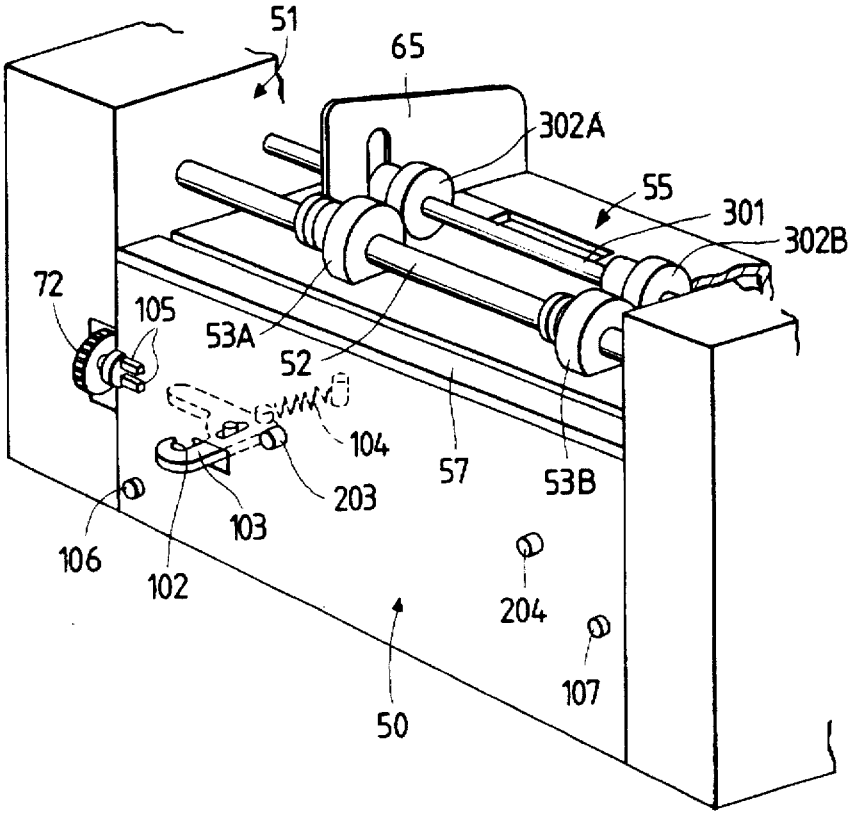
FIG. 26 is a perspective view of the automatic paper feed apparatus of FIG. 20 when viewed from a mounting surface of a recording apparatus.

FIG. 23 is a horizontal sectional view of the paper feed roller 53A on the paper feed shaft 52 and the free rotation roller 302A on the support shaft 301. FIG. 24 is a sectional view of the above structure along the line XXIV—XXIV of FIG. 23, and FIG. 25 is an end view of the structure along the line XXV—XXV of FIG. 23.

Figure 25:
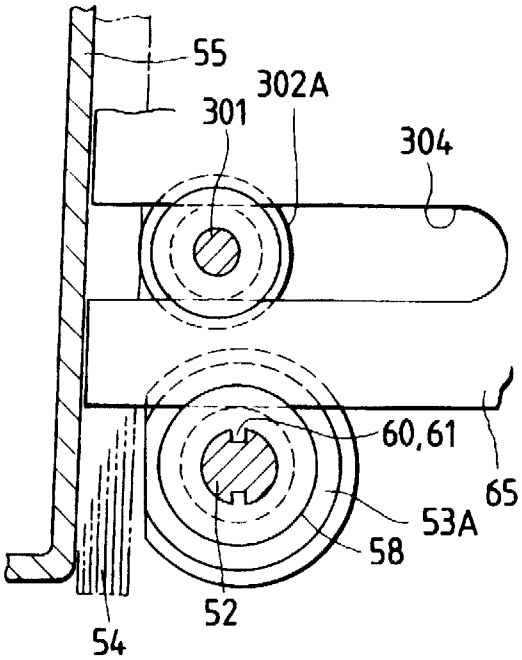
FIG. 25 is a sectional view of the structure along the line XXV—XXV of FIG. 23.

Referring to FIGS. 23 to 25, the paper feed roller 53A comprises a boss portion 58 made of a hard plastic material or the like and fitted in the paper feed roller 52, and a rubber layer 59 fixed on the outer surface of the boss portion 58 by an adhesive or the like. The circumferential surface of the paper feed roller which includes the rubber layer 59 constitutes the equi-radial sectional surface for generating a feed force and the nonequi-radial sectional surface which is kept separated from the recording sheet 54, as described above. The sectional shape of the rubber layer 59 is a semi-circular or D shape obtained by partially cutting an arc by a chord.

Axial projections 60 formed on the inner circumferential surface of the boss portion 58 are engaged with and fitted in axial grooves 61 formed in the paper feed shaft 52, so that the boss portion 58 can be rotated together with the paper feed shaft 52 and can be slid within a predetermined axial range. A cylindrical portion 62 having a smaller diameter than that of the paper feed roller and coaxially extending with the paper feed shaft 52 is formed in the boss portion 58. A circumferential groove 63 with which the sheet guide 65 is vertically engaged is formed integrally in the cylindrical portion 62.

The free rotation roller 302A is adjacent to the paper feed roller 53A and is rotatably supported on the support shaft 301 which is parallel to the paper feed roller 52. An axially extending boss portion 303 is formed on the free rotation roller 302A. A circumferential removal preventive groove 305 slidably engaged with a vertical notch 304 of the sheet guide 65 is formed on the boss portion 303. The sheet guide 65 is arranged to guide the side edges of a recording sheet 54 on a sheet stacking plate 55 and is mounted to be adjusted with respect to the sheet stacking plate 55 in the sheet widthwise direction.

The paper feed roller 53A and the free rotation roller 302A are mounted to be simultaneously moved in the sheet widthwise direction through the sheet guide 65 so as to maintain a predetermined positional relationship.

The positions and outer diameters of the free rotation rollers 302A and 302B are determined so that the rollers 302A and 302B are slightly separated from the recording sheet 54 farther than the paper feed surfaces (equi-radial sectional surfaces) of the paper feed rollers 53A and 53B, i.e., the surfaces of the rollers 302A and 302B are slightly retracted from the paper feed surfaces, but are closer to the recording sheet 54 than the notches (nonequi-radial sectional surfaces) of the paper feed rollers, i.e., the surfaces of the rollers 302A and 302B slightly extend from the paper feed surfaces. The free rotation rollers 302A and 302B are made of a material such as a hard plastic material having a relatively small frictional coefficient.

The sheet guide 65 is mounted to be slidable within a predetermined range of the sheet width with respect to the sheet stacking plate 55. A distal end portion 113 of the sheet guide 65 is engaged with the circumferential groove 63 (FIG. 23) of the paper feed roller 53A, and the almost vertical notch 304 formed in the sheet guide 65 is slidably engaged with the circumferential groove 305 of the free rotation roller 302A. For this reason, when the sheet guide 65 is moved so as to adjust the paper width, the paper feed roller 53A and the free rotation roller 302A adjacent thereto are simultaneously moved to predetermined positions, respectively.

The right paper feed roller 53B and the right free rotation roller 302B in FIG. 22 are mounted on the paper feed roller 52 at predetermined positions, so that they constitute an almost symmetrical arrangement with the paper feed roller 53A and the free rotation roller 302A. Since the paper feed roller 53B is fixed on the paper feed shaft 52 and the free rotation roller 302B is rotatable on the support shaft 301 but is stationary along the axial direction, the circumferential grooves 63 and 305 are omitted, and portions corresponding to the boss portions 58 and 303 are removed. A function corresponding to the sheet guide 65 can be replaced with the inner wall surface of the cover portion 51C of a frame 51.

The right paper feed roller 53B and the right free rotation roller 302B may be moved, and the corresponding right sheet guide 65 or an equivalent member is arranged to obtain a symmetrical arrangement.

The automatic paper feed apparatus of this embodiment can be mounted on a recording apparatus 10 in the same manner as in the first embodiment shown in FIG. 3.

The third embodiment of the present invention will be described with reference to FIGS. 27 to 33.

Figure 28:
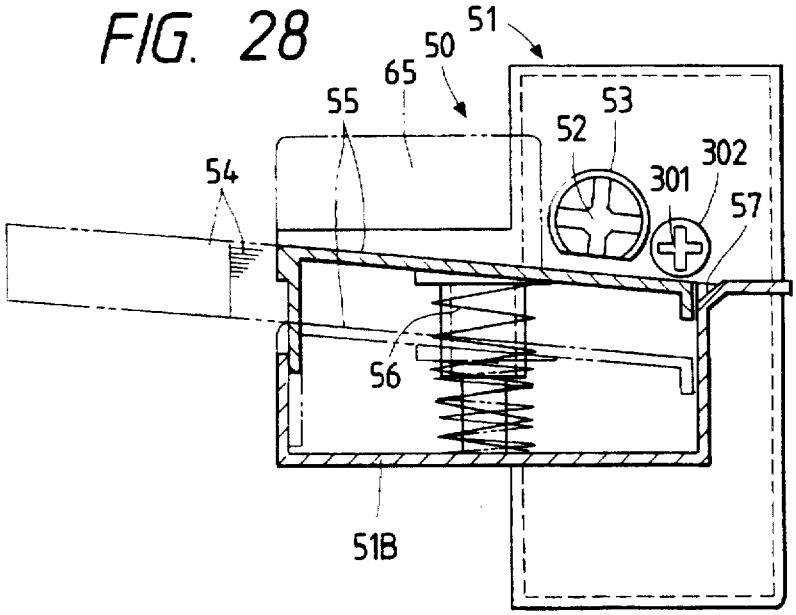
FIG. 28 is a sectional view of the structure along the line XXVIII—XXVIII of FIG. 27.
Figure 27:
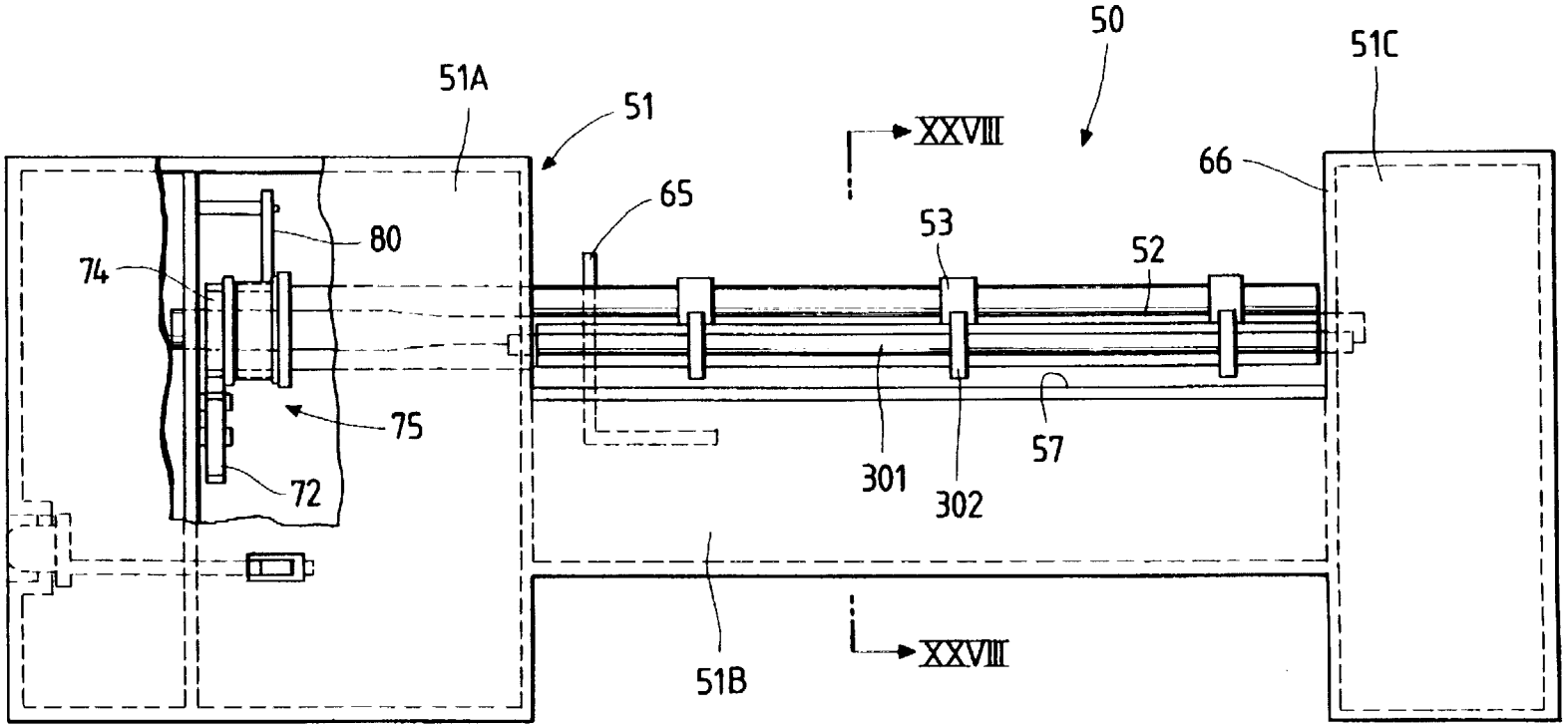
FIG. 27 is a partially cutaway front view of an automatic paper feed apparatus according to the third embodiment of the present invention.
Figure 29:
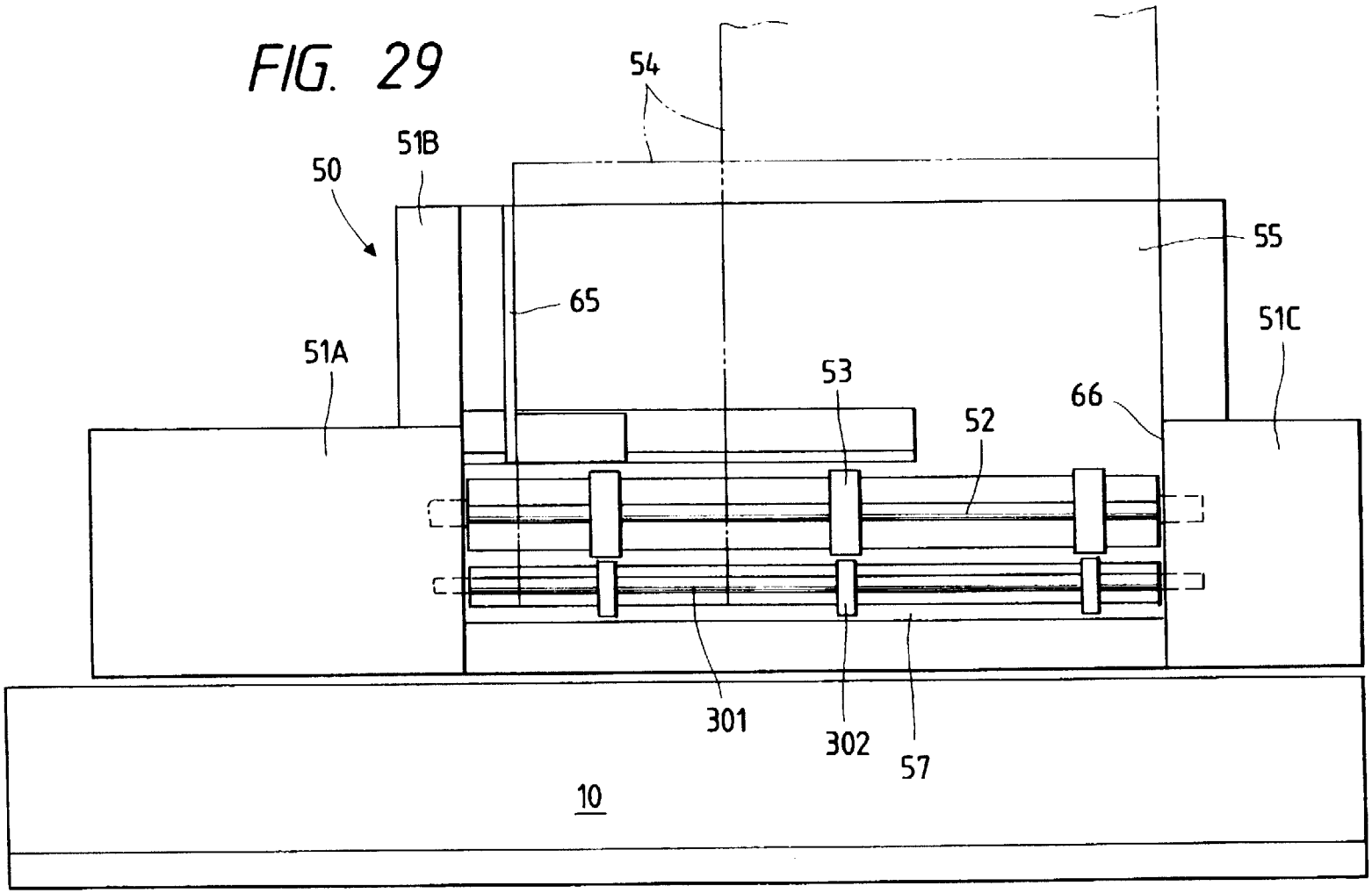
FIG. 29 is a plan view of the structure shown in FIG. 27.

FIG. 27 is a front view of this embodiment, FIG. 28 is a sectional view of a structure of this embodiment along the line XXVIII—XXVIII in FIG. 27, and FIG. 29 is a plan view of the structure in FIG. 27.

Referring to FIGS. 27 to 29, a frame 51 of an automatic paper feed apparatus 50 has an integral body. A gear box portion 51A is formed in the left portion of the frame 51, a stacking plate support portion 51B is formed at the central portion of the frame 51, and a cover portion 51C is formed in the right portion of the frame 51. A paper feed shaft 52 passes above the sheet stacking plate support portion 51B, and both end portions of the paper feed shaft 52 are rotatably supported by the gear box portion 51A and the cover portion 51C.

Three paper feed rollers 53 are mounted on the paper feed shaft 52 at equal intervals so as to be rotated together with. That is, the paper feed shaft 52 and the three paper feed rollers 53 are integral members formed by plastic molding or the like. A portion except for the end support portions of the paper feed shaft 52 has a crossed section to increase rigidity and to obtain a lightweight member.

A sheet stacking plate 55 capable of stacking a plurality of recording sheets (cut sheets) 54 can be vertically movably held on the sheet stacking plate support portion 51B of the frame 51. The sheet stacking plate 55 is biased by an urging spring 56 (FIG. 2) mounted between the frame 51 and the sheet stacking plate 55, so that the sheet stacking plate 55 is urged toward the three paper feed rollers 53. Therefore, the recording sheets 54 stacked on the sheet stacking plate 55 are always biased by the spring 56 toward the paper feed rollers 53.

The sheet guide 65 is mounted on the sheet stacking plate 55 to be movable in the sheet widthwise direction and can abut against the side edge of the stacked recording sheets 5 to regulate their position. The sheet guide 65 cooperates with a surface 66 of the vertical inner wall of the cover portion 51C of the frame 51 to regulate both the side edges of the stacked sheets 54. When recording sheets having different sizes are used as the recording sheets 54 or when recording sheet having the same size are fed in the widthwise or longitudinal direction, the sheet guide 65 is adjusted. When sheets having a predetermined size are fed in the longitudinal direction thereof, the right two paper feed rollers 53 (FIG. 27) out of the three paper feed rollers 53 are used to feed the sheets 54. However, when the sheets are fed in the widthwise direction thereof, all the paper feed rollers 53 are used to feed each sheet.

A separating means 57 comprising an ascending surface on which the uppermost recording sheet 54 can ride is formed in front of the paper feed rollers 53 in the paper feed direction or at a position adjacent to the front end of the sheet stacking plate 55.

Each of the paper feed rollers 53 comprises a semi-circular roller as a semi-circular (D-shaped) member having equi- and nonequi-radial sectional surfaces. The equi-radial sectional surface is a circumferential surface brought into contact with the recording sheet 54 to feed it, while the nonequi-radial sectional surface is a circumferential surface kept separated from the recording sheet 54 within a predetermined angular interval of a paper feed wait position (reference or initial position) as the central position.

In this embodiment, free rotation rollers 302 are located in front of the paper feed rollers 53 in the sheet feed direction and at the positions on the stacking plate 55 adjacent to the separating means 57. That is, a support shaft 301 parallel to the paper feed shaft 52 is rotatably supported by the paper feed shaft 52 on the front side in the sheet feed direction. The free rotation rollers 302 are formed integrally with the paper feed rollers 53 on the support shaft 301 at three positions, respectively.

The position and radius of each free rotation roller 302 are selected so that the roller 302 is slightly separated from the recording sheet 54 farther than the equi-radial sectional surface of the corresponding paper feed roller 53 (i.e., it slightly retracted from the equi-radial sectional surface) but is closer to the recording sheet 54 than the nonequi-radial sectional surface of the corresponding paper feed roller 53 (i.e., it slightly extends from the nonequi-radial sectional surface). Each free rotation roller 302 is in contact with the stacked sheet 54 while the equi-radial sectional surface of the corresponding paper feed roller is separated from the stacked sheet 54, thereby always applying a force to the stacked sheets 54. The free rotation rollers 302 do not apply any resistance (brake) to feeding of the recording sheet from the recording apparatus.

Both end portions of the support shaft 301 are rotatably supported by the gear box portion 51A and the cover portion 51C, respectively.

In this embodiment, the support shaft 301 and the free rotation rollers 302 are integral members made by plastic molding or the like. Similarly, a portion except for end portions of the support shaft 301 has a crossed section to increase rigidity and provide a lightweight member.

Since the free rotation rollers 302 are located in front of the paper feed rollers 53 at the front end portion of the stacking plate 55, the free rotation rollers 302 prevent floating of the recording sheet 54 nearest the separating means 57. Therefore, separation of the recording sheets 54 from each other at the time of feeding can be further improved.

The free rotation rollers 302 may be located behind the paper feed rollers 53. Four or more paper feed rollers 53 and four or more free rotation rollers 302 may be used. When the three free rotation rollers 302 and the three paper feed rollers 53 are arranged, as shown in FIG. 27, sheets having predetermined sizes such as postcards and cut sheets can be fed one by one along widthwise or longitudinal direction thereof by bringing at least two roller pairs into contact with the fed sheet, thereby preventing deformation and ramp of the recording sheet 54.

Figure 31:
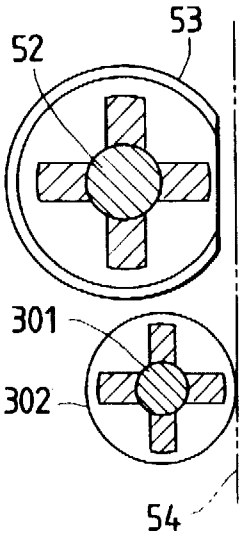
FIG. 31 is a sectional view of the structure along the line XXXI—XXXI in FIG. 30.
Figure 30:
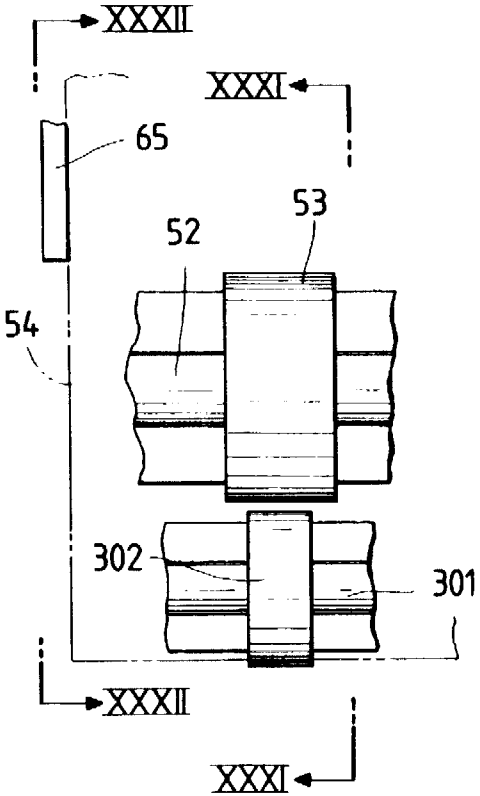
FIG. 30 is a partially horizontal sectional view showing a detailed structure of a paper feed roller and a free rotation roller shown in FIG. 27.
Figure 33:
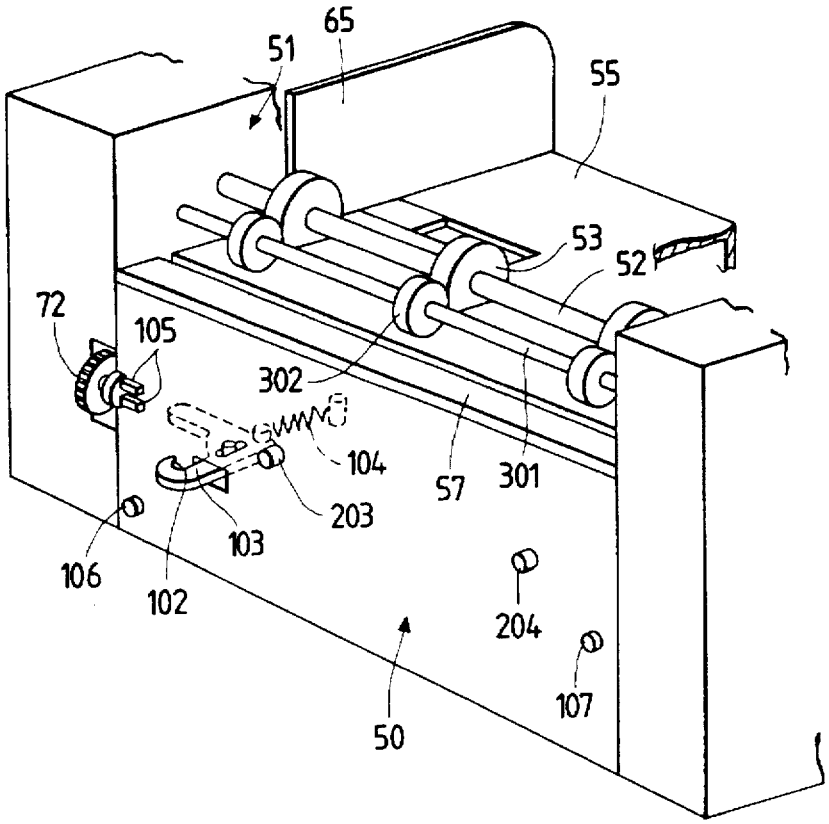
FIG. 33 is a perspective view of the automatic paper feed apparatus of FIG. 27 when viewed from a mounting surface of a recording apparatus.

FIG. 30 is a horizontal sectional view of the paper feed roller 53 on the paper feed shaft 52 and the free rotation roller 302 on the support shaft 301. FIG. 31 is a sectional view of the above structure along the line XXXI—XXXI of FIG. 30, and FIG. 32 is an end view of the structure along the line XXXII—XXXII of FIG. 30.

Figure 32:
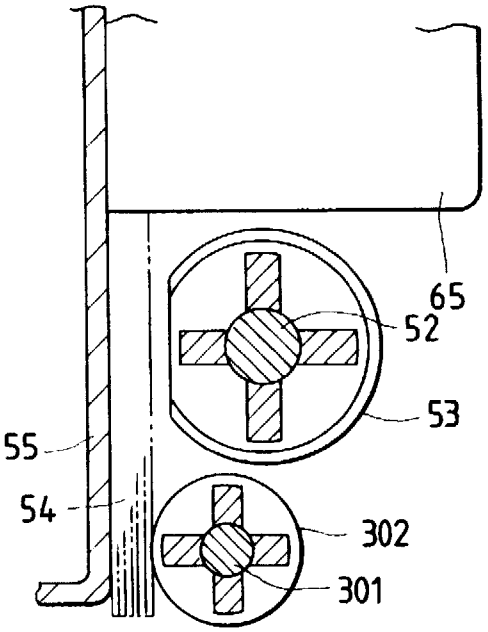
FIG. 32 is a sectional view of the structure along the line XXXII—XXXII of FIG. 30.

Referring to FIGS. 30 to 32, each of the three paper feed rollers 53 and the paper feed roller 52 are made of a hard plastic material or the like. A rubber layer 59 is fixed by an adhesive or the like on the circumferential surface (i.e., the range of the equi-radial sectional surface in the illustrated member) of each paper feed roller 53. The circumferential surface (including the rubber layer) of the paper feed roller 53 has an equi-radial sectional surface for generating a feed force and a nonequi-radial sectional surface kept separated from the recording sheet 54. This circumferential surface has a semi-circular or D shape obtained by cutting part of a circle by a chord.

A support shaft 301 parallel to the paper feed shaft 52 is integrally made of a hard plastic material (a material having a small frictional coefficient is preferable). This support shaft 301 is rotatably supported by both end portions of the frame 51. The three free rotation rollers 302 are freely rotated together with the support shaft 301.

The position and outer diameter of each free rotation roller 302 are selected so that the free rotation roller 302 has a circumferential surface (i.e., an abutment portion with the recording sheet 54) slightly separated (low) from the recording sheet 54 farther than the paper feed portion (equi-radial sectional surface) of the corresponding paper feed roller 53 and closer (high) to the recording sheet 54 than the notch (nonequi-radial sectional surface) of the paper feed roller. The free rotation rollers 302 are in contact with the recording sheet when the equi-radial sectional surfaces of the paper feed rollers 53 are not brought into contact with the recording sheet.

The sheet guide 65 serves to guide the side edge of the recording sheets 54 on the sheet stacking plate 55. As will be described with reference to FIGS. 18 and 19, the sheet guide 65 is movable (slidable) within a predetermined range of the sheet width on the sheet stacking plate 55.

Since the sheet guide 65 is moved (vertically in FIG. 30) with respect to the paper feed rollers 53 and the free rotation rollers 302, the sheet guide 65 is located at a position where it is not brought into contact with the paper feed rollers 53 and the free rotation rollers 302. In this embodiment, the sheet guide 65 is located only on the left side. A function corresponding to the right sheet guide is constituted by the inner side wall surface of the cover portion 51C of the frame 51.

Movable sheet guides may be located at both the right and left sides, as needed.

As in the previous embodiments, since the free rotation rollers 302 are located behind the paper feed rollers 53, floating of the recording sheets on the stacking plate 55 can be effectively prevented. In this embodiment, since the free rotation rollers 302 are located in front of the paper feed rollers 53, floating of the recording sheet 54 nearest the separating means 57, separation of the recording sheets 54 from each other at the time of feeding can be further improved.

The automatic paper feed apparatus of this embodiment can be mounted on a recording apparatus 10 in the same manner as in the first embodiment shown in FIG. 3.

Figure 35:
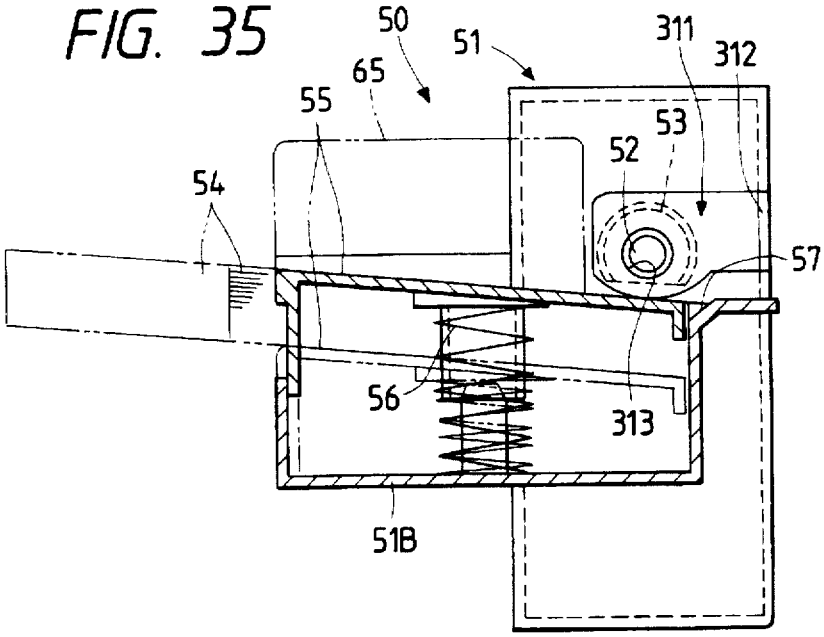
FIG. 35 is a sectional view of the apparatus along the line XXXV—XXXV of FIG. 34.
Figure 34:
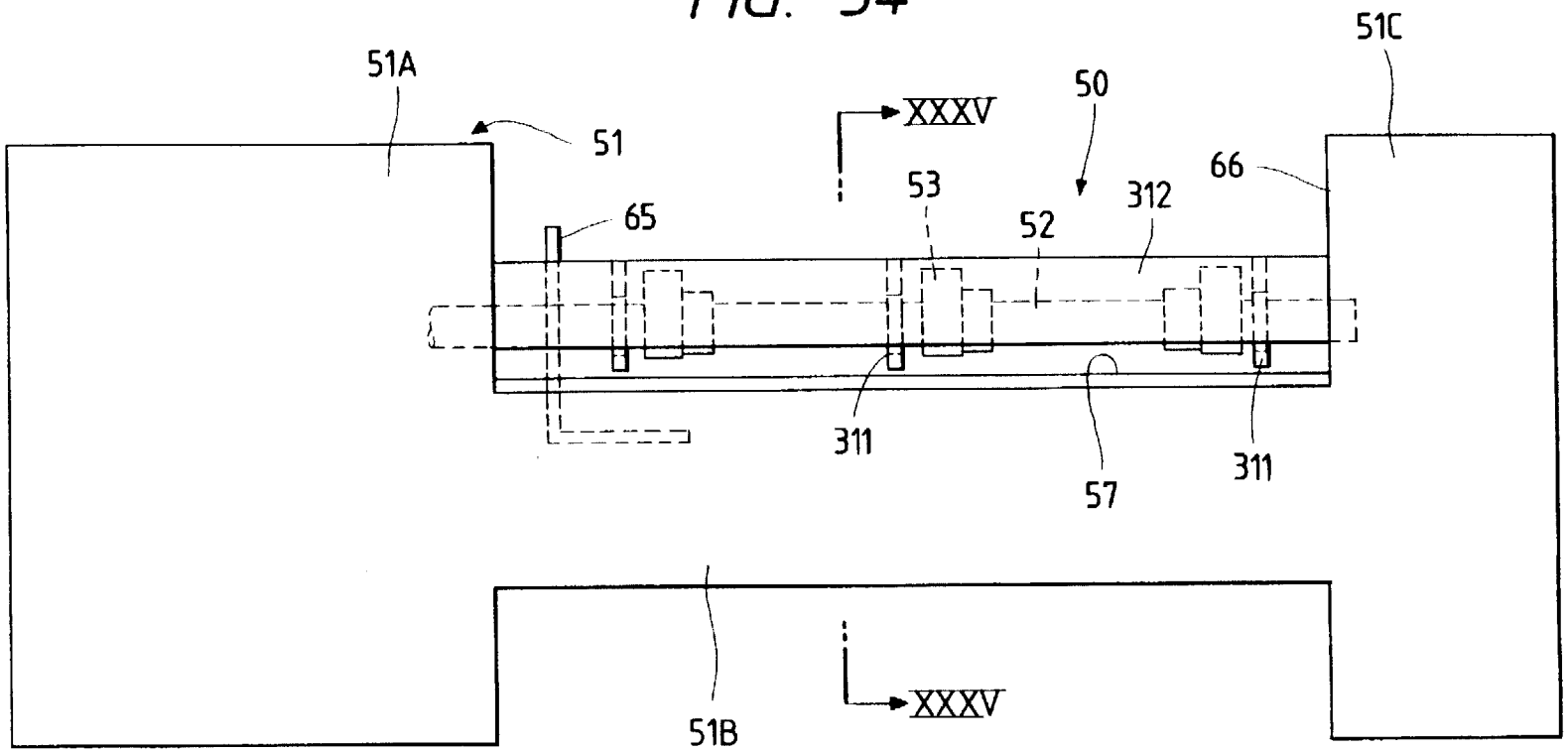
FIG. 34 is a partially cutaway front view of an automatic paper feed apparatus according to the fourth embodiment of the present invention.
Figure 36:
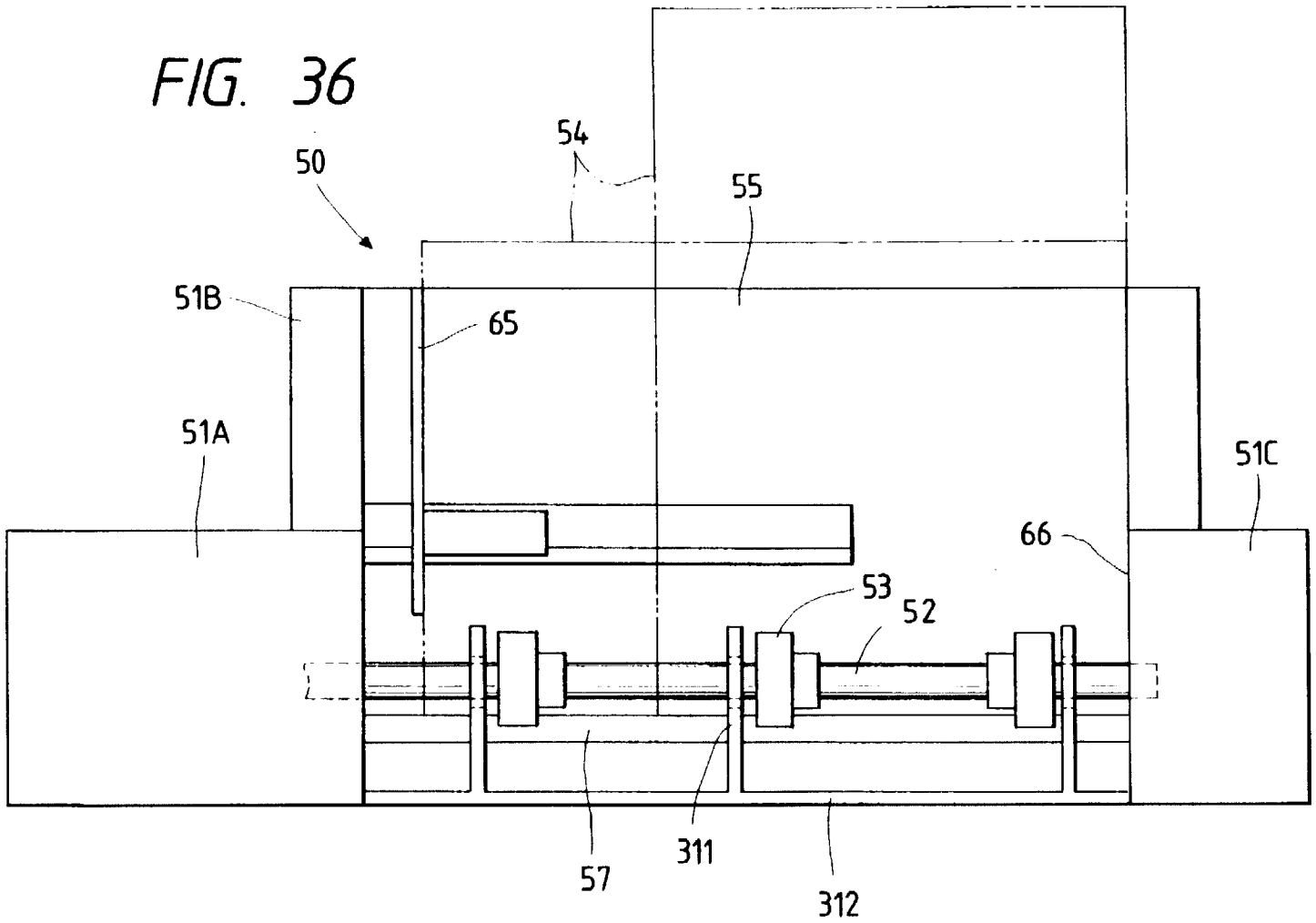
FIG. 36 is a plan view of the apparatus shown in FIG. 34.

FIG. 34 is a front view showing an automatic paper feed apparatus according to the fourth embodiment of the present invention. FIG. 35 is a sectional view of the apparatus along the line XXXV—XXXV of FIG. 34, and FIG. 36 is a plan view of the apparatus shown in FIG. 34.

In this embodiment, guide members 311 which are brought into contact with a recording sheet 54 on a sheet stacking plate 55 are arranged in place of the free rotation rollers 302 of the second embodiment. Three paper feed rollers 53 are located at fixed positions in the sheet widthwise direction. In this embodiment, each paper feed roller 53 is fixed on a paper feed roller 52 pivoted to transmit a rotational driving force and is not relatively moved along the rotational and axial directions.

The guide members 311 comprise almost vertical plate members located near the respective paper feed rollers 53 along the sheet widthwise direction. Each guide member 311 is integrally formed with a frame 51 of an automatic paper feed apparatus 50. In the illustrated arrangement, each guide member 311 integrally extends backward from a stay 312 for connecting a gear box portion 51A and a cover portion 51C.

A shaft (paper feed shaft) 52 of each paper feed roller 53 is located to extend through the corresponding one of the guide members 311. An opening 313 (FIG. 35) is formed in each guide member 311 to receive the paper feed shaft 52. Each guide member 311 has a shape located slightly lower (separated from the recording sheet 54) than an equi-radial sectional surface (i.e., a circumferential surface brought into contact with the recording sheet 54 to feed it) of each paper feed roller and higher (extends toward the recording sheet 54) than the nonequi-radial sectional surface (semi-circular portion), so that the each guide member 311 can be brought into contact with the recording sheet 54 on the sheet stacking plate 55.

Since the positions of the paper feed rollers 53 and the guide members 31 are stationary, the sheet guide 65 is separated from these members, so that the sheet guide 65 is mounted to be singly movable to the sheet on the sheet stacking plate 55.

This embodiment is different from the previous embodiments in the above respect. However, other parts of this embodiment are substantially the same as those of the previous embodiments. The same reference numerals as in the previous embodiments denote the same parts in this embodiment, and a detailed description thereof will be omitted.

As compared with each embodiment described above, the free rotation rollers 302 and their support shaft can be omitted in this embodiment, and the guide members 311 corresponding to the free rotation rollers 302 can be integrally formed with the frame 51. Therefore, a compact, lightweight paper feed apparatus can be obtained at low cost.

Four or more paper feed rollers 53 and four or more guide members 311 may be arranged. However, since the three paper feed rollers 53 and the three guide members 311 are located as an illustrated arrangement, sheets having predetermined sizes such as postcards and cut sheets can be fed one by one along widthwise or longitudinal direction thereof by bringing at least two roller pairs into contact with the fed sheet, thereby preventing deformation and ramp of the recording sheet 54 and hence performing stable paper feeding.

Figure 37:
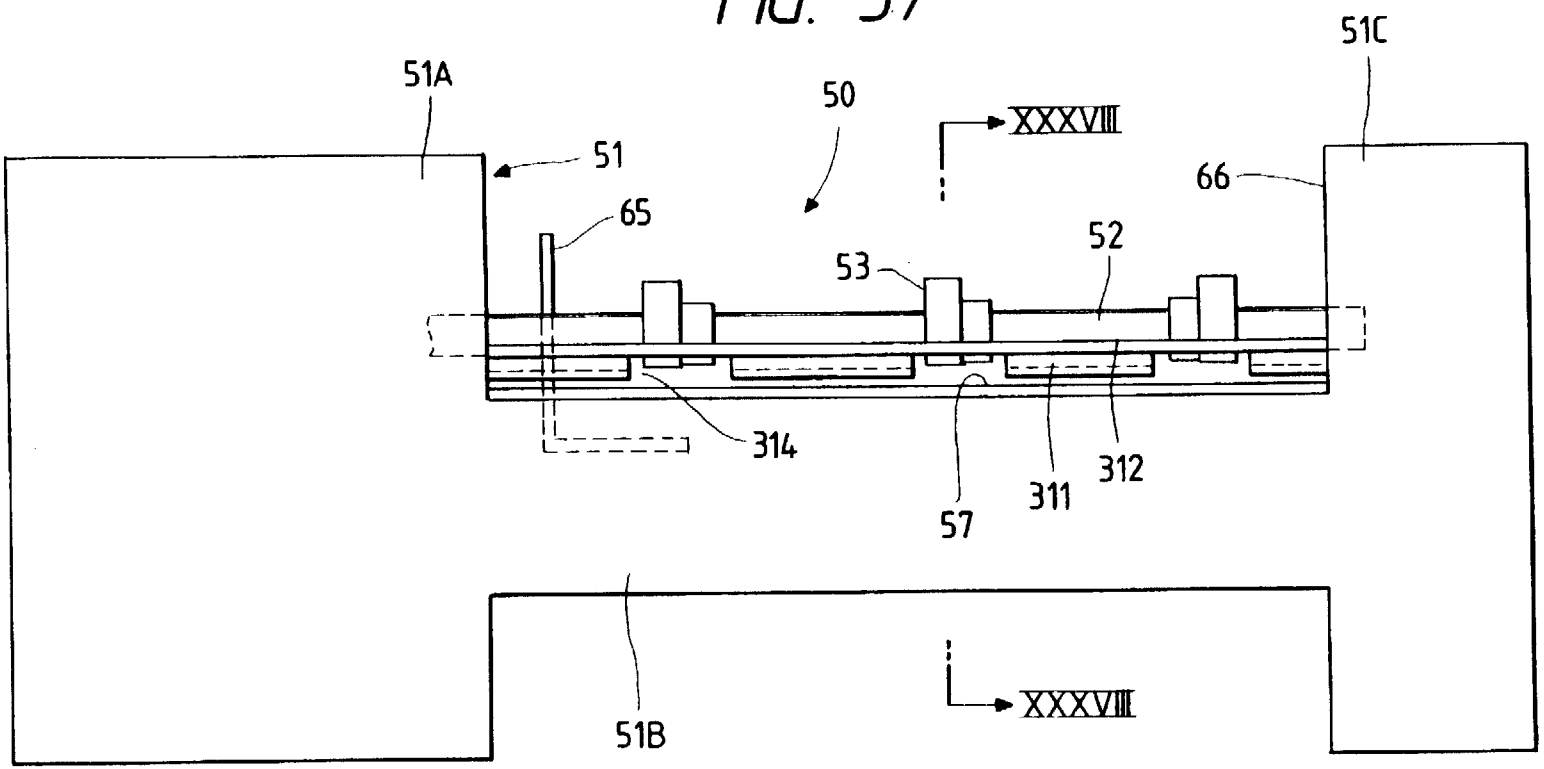
FIG. 37 is a partially cutaway front view of an automatic paper feed apparatus according to the fifth embodiment of the present invention.
Figure 38:
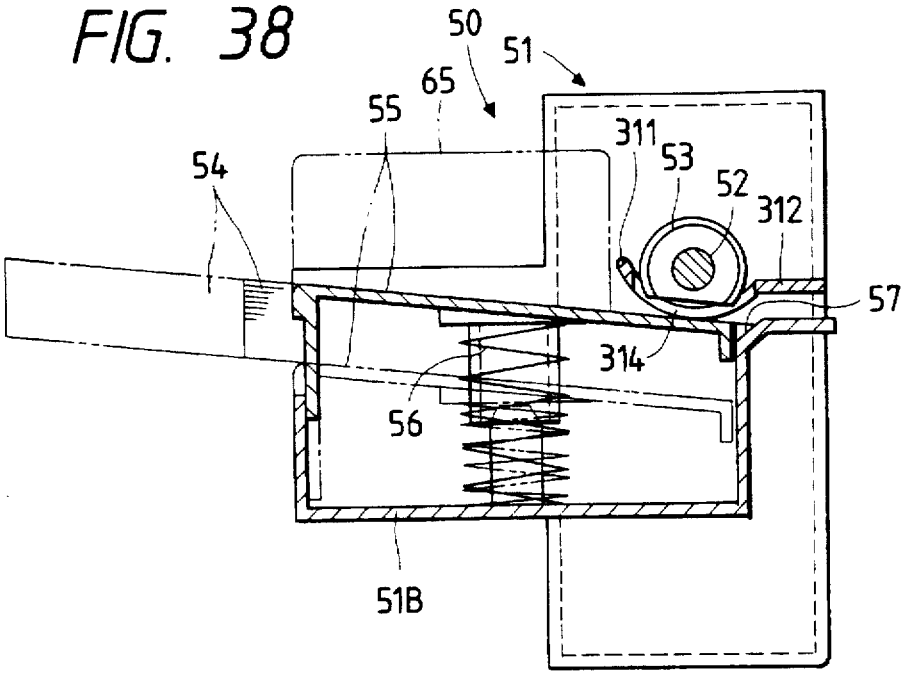
FIG. 38 is a sectional view of the apparatus along the line XXXVIII—XXXVIII of FIG. 37.
Figure 39:
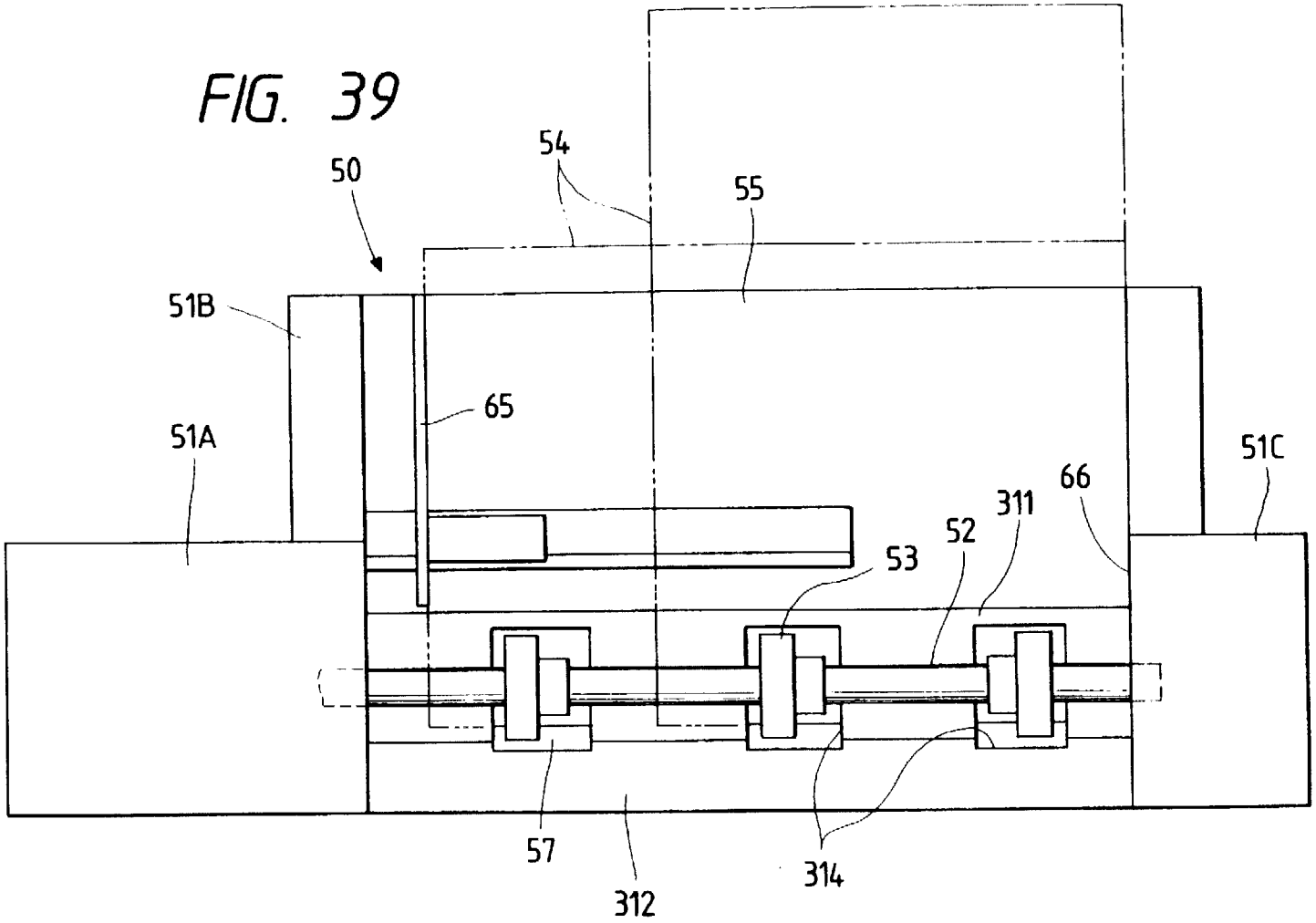
FIG. 39 is a plan view of the apparatus shown in FIG. 37.

FIG. 37 is a front view showing an automatic paper feed apparatus according to the fifth embodiment of the present invention, FIG. 38 is a sectional view of the apparatus along the line XXXVIII—XXXVIII of FIG. 37, and FIG. 39 is a plan view of the apparatus shown in FIG. 37.

In this embodiment, the almost vertical plate-like guide members 311 in the fourth embodiment are replaced with plate-like guide members each having a predetermined width (full width of the paper in the illustrated arrangement) having a spoon-like shape or extending downward.

In this embodiment, openings 314 are formed at regions corresponding to paper feed rollers 53 between the guide members 311.

The three paper feed rollers 53 are formed at fixed positions along a paper feed shaft 52 in the sheet widthwise direction in the same manner as in the third embodiment. That is, each paper feed roller 53 is fixed on the paper feed roller 52 pivoted to transmit a rotational driving force and is not relatively moved along the rotational and axial directions.

Each guide member 311 in this embodiment has a shape to be brought into contact with a recording sheet 54 on a stacking plate 55 at the paper feed position of the corresponding one of the feed rollers 53. The downward bent portion of each guide member 311 has a shape which is slightly lower than the equi-radial sectional surface (i.e., a circumferential surface brought into contact with the recording sheet 54) of each paper feed roller 53 and which is higher than the nonequi-radial sectional surface (semi-circular portion), so that the downward bent portion can be brought into contact with the recording sheet 54 on the sheet stacking plate 55.

Each guide member 311 is formed integrally with a frame 51 of an automatic paper feed apparatus 50 and integrally extends backward from a stay 312 for connecting a gear box portion 51A and a cover portion 51C.

This embodiment is different from the previous embodiments in the above respect. However, other parts of this embodiment are substantially the same as those of the previous embodiments. The same reference numerals as in the previous embodiments denote the same parts in this embodiment, and a detailed description thereof will be omitted.

In this embodiment, since all the paper feed rollers 53 and all the guide members 311 are stationary, the sheet guide 65 is separated from these members, so that the sheet guide 65 is mounted to be singly movable to the sheet on the sheet stacking plate 55.

Four or more paper feed rollers 53 and four or more guide members 311 may be arranged. However, since the three paper feed rollers 53 and the three guide members 311 are located as an illustrated arrangement, sheets having predetermined sizes such as postcards and cut sheets can be fed one by one along widthwise or longitudinal direction thereof by bringing at least two roller pairs into contact with the fed sheet, thereby preventing deformation and ramp of the recording sheet 54 and hence performing stable paper feeding.

In each embodiment described above, contact between the paper feed rollers 53 and the recording sheet 54 is released at the reference position, and the free rotation rollers 302 or the guide members 311 for holding the recording sheets at the reference position are arranged on another supporting shaft 301 independently of the paper feed shaft 52 or are arranged singly. For this reason, a load (contact force) of the paper feed shaft 52 at the reference position can be eliminated. Driving efficiency for driving the paper feed roller 52 through a spring clutch or the like can be improved. In addition, a motor as a driving source can be made compact and simple with low power consumption, thereby achieving a lightweight, compact arrangement at low cost.

Furthermore, since the sheet guide 65 is not engaged with the paper feed rollers 53 and the like and can be positioned singly, a load (force) acting on a slide mechanism for the sheet guide 65 can be eliminated. Variations in contact force at the side edge of the recording sheet upon each operation of the sheet guide 65 can be eliminated. The recording sheet 54 can be guided with a contact force. Therefore, there is provided an automatic paper feed apparatus capable of perfectly preventing ramp and deformation of the recording sheet 54 during feeding.

Figure 40:
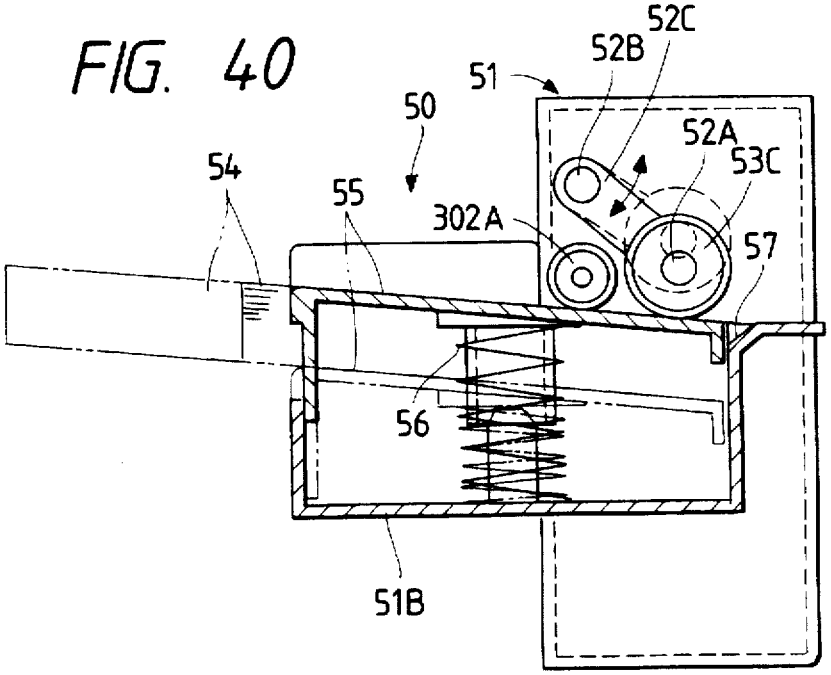
FIG. 40 is a partially cutaway front view of an automatic paper feed apparatus according to the sixth embodiment of the present invention.

FIG. 40 shows the sixth embodiment of the present invention.

In this embodiment, in place of the semi-circular roller in each embodiment described above, a paper feed roller is swingably arranged to be brought into contact or separated from an upper surface of a stacked sheet. More specifically, a paper feed roller 53C is rotatably supported on a shaft 52A, and the shaft 52A is supported to be pivotal about a shaft 52B by a lever 52C. The paper feed roller 53C receives a rotational force from a drive transmitting means (not shown).

With this arrangement, when the paper feed roller 53C feeds a recording sheet 54 and is rotated by one revolution, the paper feed roller 53C is swung to a position to be separated from the upper surface of the recording sheet 54, as indicated by the dotted line in FIG. 40. At this time, a free roller 302A is brought into contact with the upper surface of the recording sheet 54 and holds the uppermost recording sheet to a position corresponding to an inclined surface 57, thereby properly separating the recording sheets 54 one by one.

Figure 41:
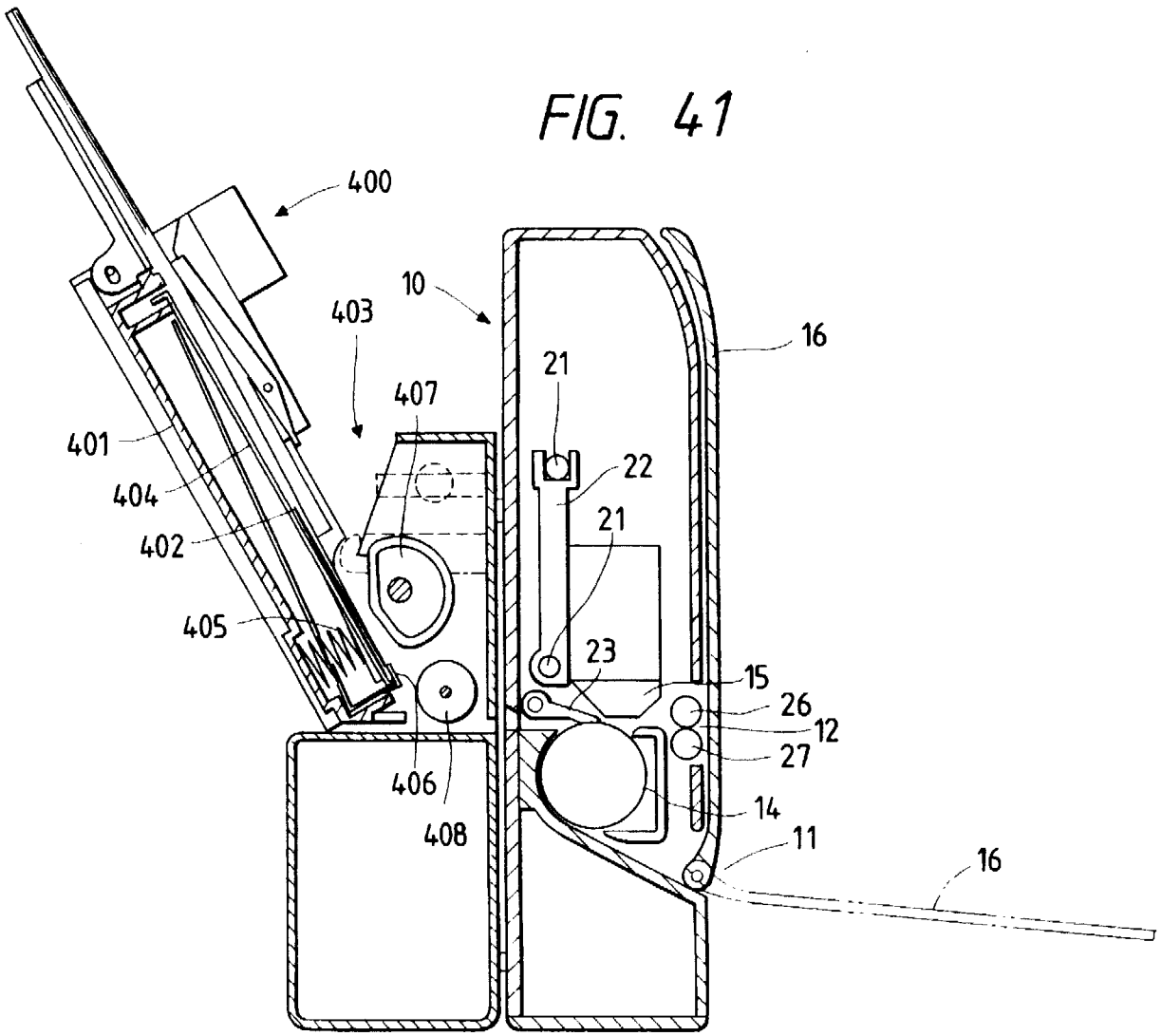
FIG. 41 is a sectional view showing an arrangement wherein a paper feed apparatus other than an automatic paper feed apparatus is mounted on an image recording apparatus.

An arrangement obtained by connecting another automatic paper feed apparatus 400 to a recording apparatus 10 will be described with reference to FIG. 41.

The automatic paper feed apparatus 400 comprises a paper feed cassette 401 for storing recording sheets 402 and a paper feed unit 403 for feeding each recording sheet 402 from the paper feed cassette 401 to the recording apparatus 10. The paper feed cassette 401 comprises a press plate 404 on which the recording sheets 402 are stacked, a spring 405 for biasing the press plate 404 toward the paper feed unit 403, and a separation gripper 406 for holding leading corners of the recording sheets. A semi-circular roller 407 and an auxiliary feed roller 408 are arranged in the paper feed unit 403.

The automatic paper feed apparatus 400 and the recording apparatus 10 can be connected by the same means as in the previous embodiments. A driving force of the paper feed roller 407 and the auxiliary paper feed roller 408 is transmitted from the recording apparatus to the automatic paper feed apparatus through a gear train in the same manner as in the previous embodiments.

With this arrangement, when the paper feed roller 407 is rotated, each recording sheet 402 is fed out from the paper feed cassette 401. At this time, the recording sheets 402 are separated one by one by the separation gripper 406. The separated recording sheet 402 is fed to the recording apparatus 10 through the auxiliary paper feed roller 408. The subsequent recording operation is the same as that of the previous embodiments.

The automatic paper feed apparatus 50 of each embodiment described above is suitable for feeding of a thick recording sheet or a rigid recording sheet. The automatic paper feed apparatus 400 of this embodiment is suitable for feeding normal recording sheets.

An ink-jet recording system suitable for the recording apparatus 10 will be described below.

The ink-jet recording system comprises liquid ejection ports for ejecting a liquid recording ink as flying droplets, fluid flow paths communicating with the ejection ports, and ejection energy generating means, arranged midway along the liquid flow paths, for generating ejection energies for forming flying droplets of the liquid ink in the paths. The ejection energy generating means are selectively driven in accordance with an image signal, and ink droplets are ejected to form an image.

A method of generating the ejection energy is a method using a pressure energy generating means such as electromechanical conversion elements (e.g., piezoelectric elements), a method using an electromagnetic energy generating means for irradiating a liquid ink with an electromagnetic wave such as a laser to eject the ink upon heating, or a method using a heat energy generating means for heating the liquid ink with electrothermal conversion elements to eject the ink. Of these methods, a system for ejecting the ink by using the heat energy generating means such as electrothermal conversion elements is suitable because it allows high-resolution recording because the liquid ejection ports can be arranged at a high density and a compact recording head can be arranged.

A serial ink-jet recording system will be exemplified as the ink-jet recording system below.

Figure 42:
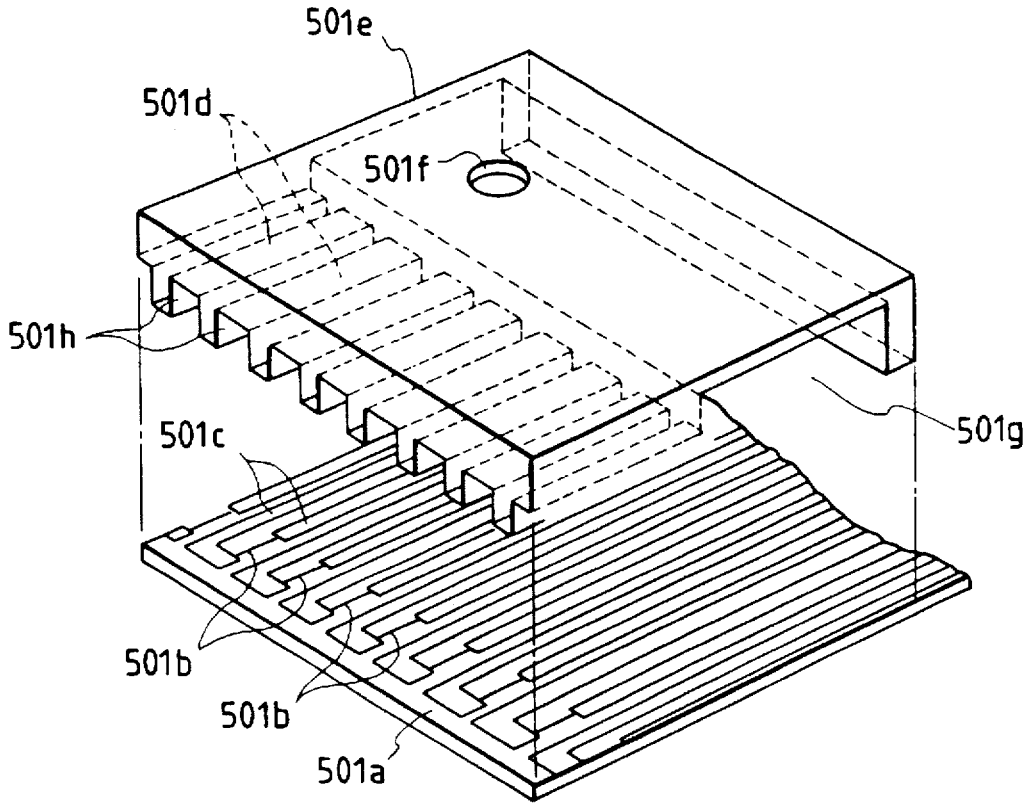
FIG. 42 is an exploded view showing a recording head used in an ink-jet recording means.

FIG. 42 is an exploded view showing a recording head 501 constituting a recording means, and FIGS. 43A to 43G are views for explaining the principle of bubble-jet recording. The typical arrangement and principle of bubble-jet recording are disclosed in U.S. Pat. Nos. 4,723,129 and 4,740,796.

The serial ink-jet recording system in FIG. 42 includes a heater board 501*a*, electrothermal conversion elements (ejection heaters) 501*b* formed on a silicon substrate, electrodes 501*c* formed on the silicon substrate and made of aluminum to supply powers to the electrothermal conversion elements 501*b*. A top plate 501*e* having partition walls for partitioning liquid paths (nozzles) 501*d* of the recording liquid is adhered to the heater board 501*a*. An ink cartridge for supplying the ink to the recording head 501 is interchangeably mounted at a predetermined position of the system.

The ink supplied from the ink cartridge through a tube is filled in a common liquid chamber 501*g* in the recording head 501 from a supply port 501*f* formed in the top plate 501*e*. The ink is guided from the common liquid chamber 501*g* to each nozzle 501*d*. Ink ejection ports 501*h* are respectively formed in the nozzles 501*d*. The ejection ports 501*h* are arranged in the recording head 501 at predetermined pitches along the sheet convey direction so as to oppose the recording sheet.

In this arrangement, the recording head 501 is mounted on a reciprocal carriage, and the inks are ejection from the recording head 501 in synchronism with movement of the carriage, thereby performing recording.

The ink flying principle in the ink-jet recording system will be described with reference to FIGS. 43A to 43G.

Figure 43A:
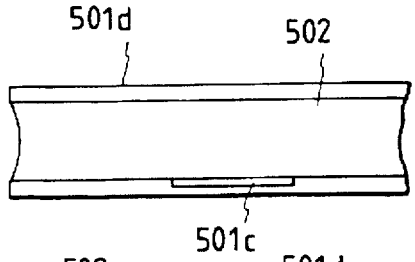
FIGS. 43A to 43G are views for explaining the principle of ink-jet recording upon ejection of an ink droplet by growth of a bubble.
Figure 43B:
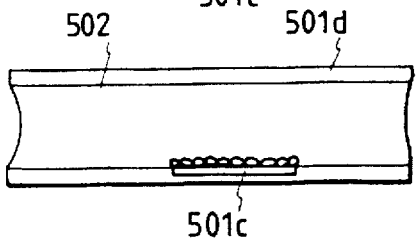
Figure 43C:
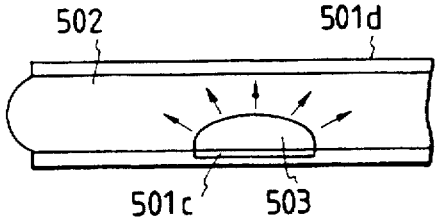

In a steady state, as shown in FIG. 43A, the surface tension of the ink 502 filled in the nozzle 501*d* is balanced with an external pressure on the surface of the ejection port. In this state, in order to cause the ink 502 to fly as a droplet, the electrothermal conversion element 501*b* in this nozzle 501*d* is energized to cause an abrupt temperature rise exceeding a film boiling temperature of the ink in the nozzle 501*d*. As shown in FIG. 43B, the ink adjacent to the electrothermal conversion element 501*b* is heated to form a small bubble. The ink of the heated portion is evaporated to cause film boiling, so that the bubble 503 is abruptly grown, as shown in FIG. 43C.

Figure 43D:
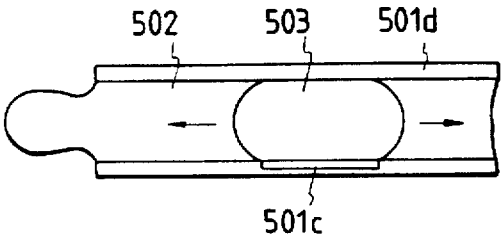
Figure 43E:
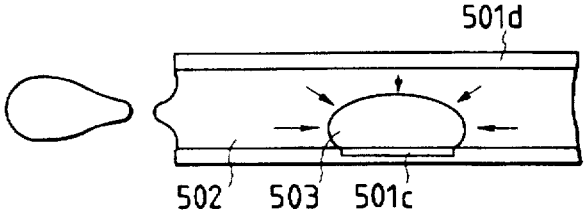
Figure 43F:
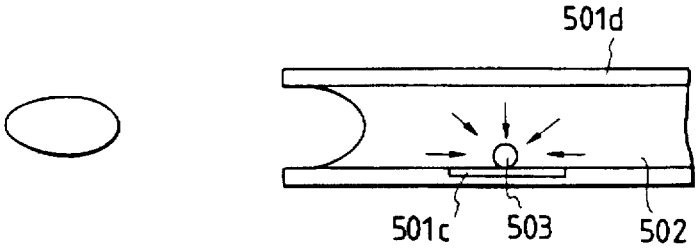
Figure 43G:
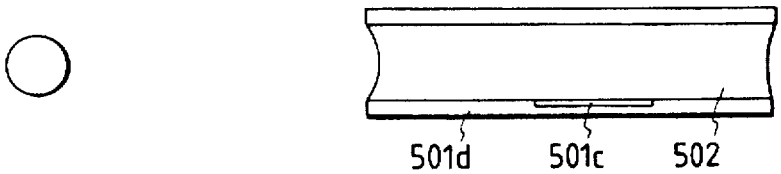

When the bubble 503 is maximally grown, as shown in FIG. 43D, an ink droplet is pushed from the ejection port in the nozzle 501*d*. When energization of the electrothermal conversion element 501*b* is completed, the grown bubble 503 is cooled by the ink 502 in the nozzle 501, so that the bubble contracts, and the ink droplet flies from the ejection port by growth and contraction of the bubble, as shown in FIG. 43E. As shown in FIG. 43F, the ink is brought into the surface of the electrothermal conversion element 501*b*, and the electrothermal conversion element 501*b* is abruptly cooled, so that the bubble 503 disappears or contracts to have a negligible volume. When the bubble 503 contracts, the ink is supplied from the common liquid chamber 501*g* into the nozzle 501*d* by a capillary phenomenon, as shown in FIG. 43G, thereby preparing for the next energization cycle. When the carriage is reciprocated and the electrothermal conversion elements 501*b* are selectively energized in accordance with an image signal in synchronism with movement of the carriage, an ink image is recorded on a recording sheet.

A recovery means is preferably arranged at an end of the movement range of the carriage in the ink-jet recording system.

The recovery means covers the ink ejection surface of the recording head 501 to prevent the ink near the ejection port of the recording head 501 from drying or prevent solidification of the ink upon its drying. In addition, a pump is preferably connected to this recovery means. The pump is driven to eliminate incomplete ink ejection, remove the ink, or prevent incomplete ink ejection, thereby drawing the ink from the ejection port and hence performing a recovery treatment.

What is claimed is:

1. An automatic sheet feeding apparatus comprising: A frame;

sheet stacking means on the frame for supporting a plurality of sheets;

rotary sheet feeding means, provided on a drive shaft, for contacting an uppermost sheet of the sheets stacked on said sheet stacking means for feeding the uppermost sheet in a feeding direction when executing a feeding process but being disposed remote from the uppermost sheet when not executing the feeding process;

biasing means on the frame for biasing the sheets stacked on said sheet stacking means toward said rotary sheet feeding means;

a separating surface disposed inclined relative to the feeding direction of the sheets for separating the sheets one by one, by causing a leading edge of the sheet fed by said rotary sheet feeding means from said sheet stacking means to abut thereagainst; and a free roller, rotatably mounted on a shaft provided on the frame of said apparatus and disposed parallel to the drive shaft, for maintaining a leading edge of the uppermost sheet at a position opposed to said separating surface against a biasing force of said biasing means when said rotary sheet feeding means does not execute the feeding process of the uppermost sheet.

2. An apparatus according to claim 1, wherein said rotary sheet feeding means comprises a sheet feeding roller having a cut surface at part of a circumferential surface thereof.

3. An apparatus according to claim 2, wherein said free roller does not contact the uppermost sheet when an uncut portion of the circumferential surface of said sheet feeding roller opposes the sheets stacked on said sheet stacking means, and contacts the uppermost sheet to maintain the uppermost sheet at a position adjacent said inclined surface when said cut surface opposes the uppermost sheet.

4. An apparatus according to claim 1, wherein said free roller is arranged integrally with the shaft for supporting said free roller.

5. An apparatus according to claim 1, wherein said rotary sheet feeding means comprises a plurality of sheet feeding rollers mounted on the drive shaft, at least one of said plurality of sheet feeding rollers being movable on said drive shaft along an axial direction thereof.

6. An apparatus according to claim 5, further comprising a sheet guide, arranged in said sheet stacking means to be movable in accordance with a sheet size, for regulating a position of the sheets in a widthwise direction, said sheet guide being interlocked with at least one of said movable sheet feeding rollers.

7. An apparatus according to claim 1, wherein said sheet feeding means comprises a roller mounted integrally with said drive shaft.

8. An apparatus according to claim 1, wherein said rotary sheet feeding means comprises three rollers located at predetermined intervals, two of said three rollers being used to feed a sheet having a small size, and said three rollers being used to feed a sheet having a large size.

9. An apparatus according to claim 1, wherein said separating surface extends in a width direction of the sheets mounted on said sheet stacking means, so that sheets fed out by said rotary sheet feeding means are separated one at a time by causing a tip end thereof to rub against said surface, and said rotary sheet feeding means and said free roller are shiftable in the sheet width direction to correspond to the sheet size.

10. An apparatus according to claim 9, further comprising a sheet guide, provided in said sheet stacking means to be movable in accordance with a sheet size, for regulating a position of the sheets in a widthwise direction thereof, said sheet guide being interlocked with said rotary sheet feed means and said free roller.

11. An automatic sheet feeding apparatus according to claim 1, wherein said free roller is disposed downstream of said rotary sheet feeding means in a sheet feeding direction.

12. An automatic sheet feeding apparatus according to claim 1, wherein said free roller is disposed upstream of said rotary sheet feeding means in a sheet feeding direction.

13. An image forming apparatus comprising:

an automatic sheet feeding device including: A frame;

sheet stacking means on the frame for supporting a plurality of sheets, rotary sheet feeding means, provided on a drive shaft, for contacting an uppermost sheet of the sheets stacked on said sheet stacking means for feeding the uppermost sheet in a feeding direction when executing a feeding process, but being disposed remote from the uppermost sheet when not executing the feeding process, biasing means on the frame for biasing the sheets stacked on said sheet stacking means toward said rotary sheet feeding means, a separating surface disposed inclined relative to the feeding direction of the sheets for separating the sheets one by one, by causing a leading edge of the sheet fed by said rotary sheet feeding means from said sheet stacking means to abut thereagainst, and a free roller, rotatably mounted on a shaft provided on the frame of said apparatus and disposed parallel to the drive shaft, for maintaining a leading edge of the uppermost sheet at a position opposed to said separating surface against a biasing force of said biasing means when said rotary sheet feeding means does not execute the feeding process of the uppermost sheet; and image forming means for forming an image on the sheets fed by said sheet feeding device.

14. An image forming apparatus according to claim 13, wherein said rotary sheet feeding means comprises a sheet feeding roller having a cut surface at part of a circumferential surface thereof.

15. An image forming apparatus according to claim 14, wherein said free roller does not contact the uppermost sheet when an uncut portion of the circumferential surface of said sheet feeding roller opposes the sheets stacked on said sheet stacking means, and contacts the uppermost sheet to maintain the uppermost sheet at a position adjacent to said inclined surface when said cut surface opposes the uppermost sheet.

16. An image forming apparatus according to claim 13, wherein said free roller is arranged integrally with the shaft for supporting said free roller.

17. An image forming apparatus according to claim 13, wherein said rotary sheet feeding means comprises a plurality of sheet feeding rollers mounted on the drive shaft, at least one of said plurality of sheet feeding rollers being movable on said drive shaft along an axial direction thereof.

18. An image forming apparatus according to claim 17, further comprising a sheet guide, arranged in said sheet stacking means to be movable in accordance with a sheet size, for regulating a position of the sheets in a widthwise direction, said sheet guide being interlocked with at least one of said movable sheet feeding rollers.

19. An image forming apparatus according to claim 13, wherein said sheet feeding means comprises a roller mounted integrally with said drive shaft.

20. An image forming apparatus according to claim 13, wherein said rotary sheet feeding means comprises three rollers located at predetermined intervals, two of said three rollers being used to feed a sheet having a small size, and said three rollers being used to feed a sheet having a large size.

21. An image forming apparatus according to claim 13, wherein said separating surface extends in a width direction of the sheets mounted on said sheet stacking means, so that sheets fed out by said rotary sheet feeding means are separated one at a time by causing a tip end thereof to rub against said surface, and said rotary sheet feeding means and said free roller are shiftable in the sheet width direction to correspond to the sheet size.

22. An image forming apparatus according to claim 21, further comprising a sheet guide, provided in said sheet stacking means to be movable in accordance with a sheet size, for regulating a position of the sheets in a widthwise direction thereof, said sheet guide being interlocked with said rotary sheet feed means and said free roller.

* * * * *

UNITED STATES PATENT AND TRADEMARK OFFICE

CERTIFICATE OF CORRECTION

PATENT NO. : 5,741,008

DATED : April 21, 1998

INVENTOR(S) : KIYOHARA ET AL.

It is certified that error appears in the above-identified patent and that said Letters Patent is hereby corrected as shown below:

COLUMN 7:

Line 54, "separated." should read --separated--.

COLUMN 20:

Lines 57 and 58, "comprising: A frame;" should read --comprising:
a frame;--.

COLUMN 22:

Line 1, "including: A frame;" should read --including:
a frame,--.

Signed and Sealed this

Tenth Day of November 1998

*Attest:*

*Attesting Officer*

BRUCE LEHMAN

*Commissioner of Patents and Trademarks*